US009250580B2

(12) United States Patent
Sugaya

(10) Patent No.: US 9,250,580 B2
(45) Date of Patent: Feb. 2, 2016

(54) IMAGE HEATING APPARATUS HAVING ROTATABLE HEATING MEMBER, EXCITATION COIL, AND A PLURALITY OF MAGNETIC CORES OR CORE GROUPS ARRANGED ALONG A LONGITUDINAL DIRECTION OF THE ROTATABLE HEATING MEMBER

(71) Applicant: CANON KABUSHIKI KAISHA, Tokyo (JP)

(72) Inventor: Kenjiro Sugaya, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/953,110

(22) Filed: Jul. 29, 2013

(65) Prior Publication Data

US 2014/0029994 A1 Jan. 30, 2014

(30) Foreign Application Priority Data

Jul. 30, 2012 (JP) ..... 2012-168932

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
USPC ..... 399/122, 328–330
See application file for complete search history.

(56) References Cited

U.S. PATENT DOCUMENTS 8,055,175 B2 11/2011 Sugaya
8,385,801 B2 2/2013 Sugaya
2010/0028061 A1* 2/2010 Nanjo et al. ..... 399/328
2010/0104334 A1* 4/2010 Nanjo ..... 399/333
2010/0178088 A1* 7/2010 Koshida et al. ..... 399/328
2010/0272482 A1* 10/2010 Nanjo ..... 399/328
2011/0076070 A1* 3/2011 Koshida ..... 399/328
2011/0182637 A1* 7/2011 Okada ..... 399/333
2011/0311250 A1* 12/2011 Urano ..... 399/45
2012/0020710 A1* 1/2012 Motoki ..... 399/334
2012/0148304 A1 6/2012 Sugaya et al.
2012/0148318 A1* 6/2012 Sugaya et al. ..... 399/329
2012/0155918 A1* 6/2012 Egi ..... 399/122
2012/0155934 A1* 6/2012 Takeuchi et al. ..... 399/329
2012/0201583 A1* 8/2012 Takeuchi ..... 399/335
2013/0034361 A1* 2/2013 Shinagawa ..... 399/67
2013/0034362 A1* 2/2013 Matsuura et al. ..... 399/69
2013/0188978 A1* 7/2013 Takeuchi ..... 399/69
2014/0037314 A1* 2/2014 Sugaya ..... 399/67

FOREIGN PATENT DOCUMENTS

JP 2010-160388 A 7/2010

* cited by examiner

*Primary Examiner* — G. M. Hyder
(74) *Attorney, Agent, or Firm* — Fitzpatrick, Cella, Harper & Scinto

(57) ABSTRACT

An image heating apparatus includes: a rotatable heating member; an coil provided outside the heating member and configured to generate heat by electromagnetic induction in the heating member; a coil holder configured to hold the coil; a plurality of magnetic cores arranged opposed to the heating member along a longitudinal direction of the heating member with the coil interposed therebetween; a core holder configured to hold at least one of the magnetic cores which is movable; and a moving mechanism configured to move the core holder between a first position and a second position which is farther away from the heating member than the first position. The core holder is provided with a stopper portion configured to stop movement of the core holder from the second position to the first position by abutment to the coil holder.

25 Claims, 21 Drawing Sheets

IMAGE HEATING APPARATUS HAVING ROTATABLE HEATING MEMBER, EXCITATION COIL, AND A PLURALITY OF MAGNETIC CORES OR CORE GROUPS ARRANGED ALONG A LONGITUDINAL DIRECTION OF THE ROTATABLE HEATING MEMBER

FIELD OF THE INVENTION AND RELATED ART

The present invention relates to an image heating apparatus for heating an image on a sheet of recording medium. An image heating apparatus is employed by an image forming apparatus such a copying machine, a printer, a facsimile machine, and so on, which records an electrophotographic, electrostatic, magnetic, or the like image forming method. It relates to also a multifunction image forming apparatus capable of functioning as two or more of the preceding examples of an image forming apparatus.

A fixing apparatus (or image heating device) for an electrophotographic image forming apparatus, for example, fixes an unfixed toner image formed on a sheet of recording medium, by the application of heat and pressure to the unfixed toner image.

As the heating method used by the fixing device for an electrophotographic image forming apparatus, a heating method based on electromagnetic induction has been known, which heats a fixing member (circularly movable heating member) by electromagnetic induction. This heating method makes it possible to place a heat source closer to toner than other heating methods, such as a heating method which uses a halogen lamp, being therefore advantageous in that it can reduce the length of time necessary to increase the surface temperature of the fixing member to a target level when the fixing device is started up. Further, its heat transmission route from the heat source to the toner is short and simple. Therefore, it is higher in thermal efficiency.

One of fixing devices employing a heating method based on electromagnetic induction is disclosed in Japanese Laid-open Patent Application 2010-160388. This fixing device which has multiple magnetic cores aligned in parallel in the lengthwise direction of its fixing member (widthwise direction of recording medium), and is structured so that one or more of the magnetic cores can be moved away from its excitation coil according to the widthwise direction of the recording medium. With the employment of this structural arrangement, as a magnetic core is moved away from the excitation coil, the portion of the fixing member, which corresponds in position to the moved magnetic core, reduces in the amount of heat it generates. Thus, this structural arrangement can prevent the lengthwise end portions of the fixing member from excessively increasing in temperature.

However, in a case where a fixing device is structured so that its magnetic cores can be moved away from its excitation coil, the effect which the positional relationship among the three members of the fixing device, more specifically, the magnetic core, excitation coil, and fixing member, has upon the heat generation efficiency of the fixing member. Thus, if the positional relation among the abovementioned three components becomes deviant at one or more magnetic cores, the fixing member is likely to become nonuniform in temperature (heat generation) in terms of its lengthwise direction. In particular, the deviation in the position (distance) of the protrusion of each magnetic core relative to the fixing member has a serious effect upon the nonuniformity of the temperature distribution of the fixing member.

In the case of the apparatus disclosed in Japanese Laid-open Patent Application 2010-160388, however, regarding the shape of each magnetic core, the portion (arch portion) of each magnetic core, which is positioned so that it becomes roughly concentric with the outward surface of the wound portion of the excitation coil, and the portion (protrusion) of the magnetic core, which protrudes toward the center of the wound portion of the excitation coil, that is, toward the fixing member, are formed as integral parts of the magnetic core.

In the case of this kind of structural arrangement, the heat generation efficiency of the fixing member is significantly affected by the positional relationship among the magnetic core, excitation coil, and fixing member. Therefore, if the above described positional relationship among each magnetic core, excitation coil, and fixing member becomes incorrect, the fixing device is likely to becomes nonuniform in the temperature of its fixing member in terms of its lengthwise direction. In particular, the deviation in position (distance) of the protrusion of the magnetic core relative to the fixing member has a serious effect upon the nonuniformity of the temperature of the fixing member.

In this case, the arched portions of each core, and the protrusion of each core, are formed as integral parts of each magnetic core. Therefore, the magnetic core of this type is more likely to be formed wrong in shape (and/or measurement) than a magnetic core, the arched portion and protrusion of which are physically independent from each other. That is, in the case of the magnetic core of this type, the position of the protrusion of each magnetic core, which has a substantial effect upon the heat generation efficiency of the fixing member, is affected by the accuracy in measurement of the arched portion of the magnetic core. Therefore, the fixing device is likely to become nonuniform in the distance between the protrusion of each magnetic core and the fixing member, in terms of the lengthwise direction of the fixing device.

SUMMARY OF THE INVENTION

According to an aspect of the present invention, there is provided an image heating apparatus comprising a rotatable heating member configured to heat an image on a recording sheet; an excitation coil provided outside said rotatable heating member and configured to generate heat by electromagnetic induction in said rotatable heating member; a coil holder configured and positioned to hold said excitation coil; a plurality of magnetic cores arranged opposed to said rotatable heating member along a longitudinal direction of the rotatable heating member with said excitation coil interposed therebetween; a core holder configured and positioned to hold at least one of magnetic cores which is movable; and a moving mechanism configured to move said core holder between a first position and a second position which is more away from said rotatable heating member than the first position, wherein said core holder is provided with a stopper portion configured and positioned to stop movement of said core holder from the second position to the first position by abutment to said coil holder.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the image heating apparatuses in accordance with the present invention are described in detail with reference to the appended drawings.

[Embodiment 1]

1. Image Forming Apparatus

Figure 1:
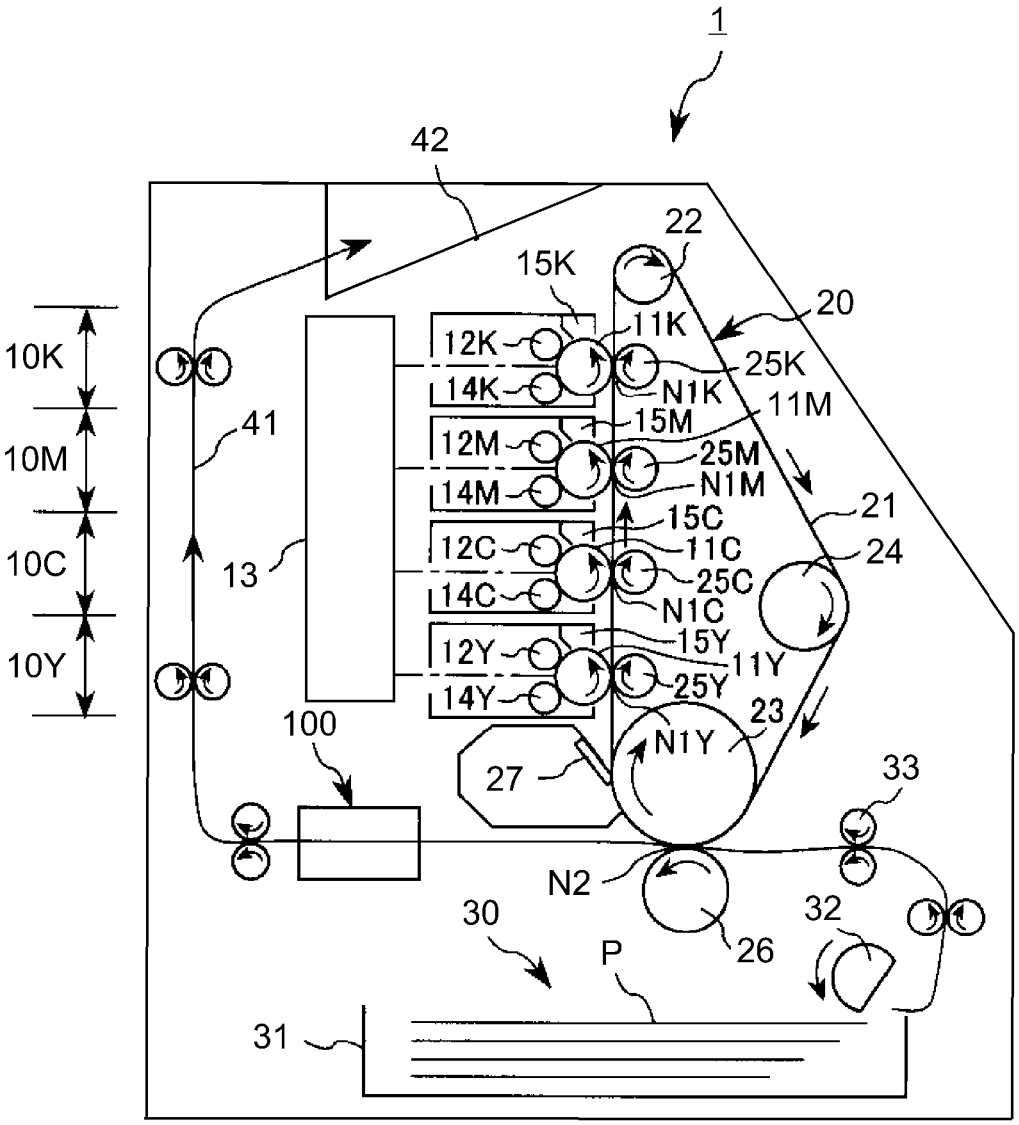
FIG. 1 is a schematic sectional view of an example of an image forming apparatus equipped with the fixing device (electromagnetic induction heating device) in the first embodiment of the present invention.

First, the general structure and operation of the image forming apparatus equipped with the image heating device in the first embodiment of the present invention is described. FIG. 1 is a schematic sectional view of the image forming apparatus 1 equipped with a fixing device 100 as the image heating device in this embodiment.

The image forming apparatus 1 is a color image forming apparatus which uses an electrophotographic image forming method. The image forming apparatus 1 has multiple image forming stations, more specifically, the first, second, third, and fourth image formation stations 10Y, 10M, 10C and 10K, which form yellow (Y), magenta (M), cyan (C) and black (K) toner images, respectively. The four image formation stations 10Y, 10M, 10C, and 10K are vertically aligned in parallel, listing from the bottom side of the apparatus 1.

The four image formation stations 10Y, 10M, 10C and 10K are practically the same in structure and operation, although they are different in the color of the toners they use. Therefore, in order to describe them together, the suffixes Y, C, M and K, which indicate the color of the toner they use, are omitted unless the four stations 10 need to be differentiated.

The image formation station 10 has a photosensitive drum 11, which is an electrophotographic image bearing member (photosensitive member). The photosensitive drum 11 is rotationally driven in the direction (counterclockwise direction) indicated by an arrow mark in FIG. 1. There are provided the following means, more specifically, a charge roller 12 as a charging means which is the form of a roller, an exposing device 13 as an exposing means, a developing device 14 as a developing means, an intermediary transfer unit 20 as a transferring device, and a drum cleaning device 15, which are positioned in the listed order in the adjacencies of the peripheral surface of the photosensitive drum 11.

There are stored yellow, cyan, magenta and black toners, as developers, in the developing devices 14Y, 14M, 14C and 14K of the first, second, third, and fourth image formation stations 10Y, 10M, 10C and 10K, respectively.

The intermediary transfer unit 20 has an intermediary transfer belt 21, as an intermediary transferring member, which is an endless belt made of film. The intermediary transfer belt 21 is suspended and kept stretched by three rollers, more specifically, a driving roller 22, a belt backing roller 23, and a tension roller 24. The intermediary transfer belt 21 is circularly driven by the driving roller 22 in the direction (clockwise direction) indicated by an arrow mark in FIG. 1. There are positioned primary transfer rollers 25, as primary transferring means (members), which are in the form of a roller, on the inward side of the loop which the intermediary transfer belt 21 forms, opposing the photosensitive drums 11, one for one. Each primary transfer roller 21 is kept pressed against the corresponding photosensitive drum 11 with the presence of the intermediary transfer belt 21 between itself and photosensitive drum 11, forming the primary transfer station N1, that is, the area of contact between the intermediary transfer belt 21 and photosensitive drum (in which intermediary transfer belt 21 is kept pressed upon photosensitive drum 11). There is also the secondary transfer roller 26 as the secondary transferring means (secondary transferring member), which is on the outward side of the abovementioned belt loop, opposing the aforementioned belt backing roller 23. The secondary transfer roller 26 is kept pressed upon the portion of the intermediary transfer belt 21, which is in contact with the peripheral surface of the belt backing roller 23 as if it partially wraps around the belt backing roller 23. The area of contact between the secondary transfer roller 26 and intermediary transfer belt 21 is the secondary transfer station N2. There is also a belt cleaning device 27 as a means for cleaning the intermediary transfer belt 21, which is positioned on the outward side of the loop which the intermediary transfer belt 21 forms, in such a manner that it opposes the belt backing roller 23.

The exposing device 13 is structured as an optical system for projecting a beam of light upon the photosensitive drum 11 of each image formation station 10, while modulating the beam of light according to the information of the image to be formed. The optical system in this embodiment is an optical system which scans the peripheral surface of the photosensitive drum 11 with a beam of laser light it outputs.

There is provided a recording medium feeding/conveying device 30 on the upstream side of the secondary transfer station N2, in terms of the direction in which a sheet P of recording medium is conveyed.

Next, the image forming operation of this image forming apparatus will be described with reference to its operation for forming a full-color image. First, the peripheral surface of the photosensitive drum 11 is roughly uniformly charged by the charge roller 12, in each image formation station 10. The charged photosensitive drum 11 is scanned (exposed) by the exposing device 13 based on the image data. Consequently, an electrostatic latent image (electrostatic image), which corresponds to the pattern of exposure of the peripheral surface of the photosensitive drum 11 is effected on the photosensitive drum 11. The electrostatic latent image formed on the photosensitive drum 11 is developed into a toner image by the developing apparatus 14, with the use of toner as developer.

On the photosensitive drums 11Y, 11M, 11C and 11K of the first, second, third, and fourth image formation stations 10Y, 10M, 10C and 10K, yellow, magenta, cyan and black toner images are formed, respectively.

The toner images, different in color, formed on photosensitive drums 11 in the image formation stations 10, one for one, are sequentially transferred (primary transfer) onto the intermediary transfer belt 21, in the primary image formations N1, one for one, in such a manner that they are aligned in layers in terms of the direction perpendicular to the surface of the intermediary transfer belt 21. During this primary transfer, the intermediary transfer belt 21 is circularly moved in synchronism with the rotation of each photosensitive drum 11 at roughly the same speed as the photosensitive drum 11. Also during this primary transfer, the primary transfer bias, the polarity of which is opposite from the normal polarity to which the toner for developing an electrostatic latent image is charged, is applied to each primary roller 25 from a primary bias power source (unshown). As a result, an unfixed full-color image is synthetically formed of unfixed toner images, different in color, on the intermediary transfer belt 21.

In each image formation station 10, the toner (residual toner from primary transfer) remaining on the photosensitive drum 11 after the primary transfer is removed from the peripheral surface of the photosensitive drum 11 by the drum cleaning device 15, and then, is recovered by the cleaning device 15.

As described above, during the formation of a full-color image, yellow, magenta, cyan and black toner images, are sequentially layered on the intermediary transfer belt 21 in synchronism with the circular movement of the intermediary transfer belt 21, in such a manner that they are alignment in terms of the direction perpendicular to the circular movement of the intermediary transfer belt 21. By the way, during the formation of a monochromatic image (monochromatic mode) of a specific color, a toner image is formed in only the image formation station 10, which uses the toner of the specific color. Then, only the monochromatic toner image of the specific color is transferred (primary transfer) onto the intermediary transfer belt 21.

Meanwhile, a sheets P of recording medium in a recording medium cassette 31 is separated, one by one, from the rest in the cassette 31, by the sheet feeding/conveying roller 32 of the recording medium conveying device 30, and then, is conveyed to the secondary transfer station N2 by a pair of registration rollers 33 with a reset timing.

The toner images transferred onto the intermediary transfer belt 21 are transferred together (secondary transfer) onto the sheet P of recording medium, in the secondary transfer station N2. During the secondary transfer, the secondary transfer bias, the polarity of which is opposite to the normal polarity to which the toner is charged to develop an electrostatic latent image, is applied to the secondary transfer roller 26.

The toner (residual toner from secondary transfer) remaining on the intermediary transfer belt 21 after the secondary transfer is removed from the intermediary transfer belt 21 by the belt cleaning device 27, and is recovered by the device 27.

The toner images, different in color, transferred (secondary transfer) onto the sheet P of recording medium are melted by the fixing device 100 while being mixed, and then, are fixed to the sheet P. The structure and operation of the fixing device 100 are described later in detail.

After the fixation of the toner images to the sheet P of recording medium, the sheet P is conveyed as a full-color print through the sheet discharge passage 41, and then, is discharged into the delivery tray 42.

2. General Structure and Operation of Fixing Device

Next, the general structure of the fixing device 100 as an image heating device is described.

By the way, in the following description of the fixing device 100, the "lengthwise direction, widthwise direction, front surface, rear surface, left, right, upstream and downstream" means the following: The lengthwise direction (widthwise direction), is the direction which is roughly perpendicular to the direction in which the sheet P of recording medium is conveyed through the recording medium conveyance passage. The widthwise direction is the direction perpendicular to the above described lengthwise direction, that is, the direction which is roughly parallel to the direction in which the sheet P is conveyed through the recording medium conveyance passage. The front surface is the surface of the fixing device, which is on the side of the fixing device 100, from which the sheet P is entered into the fixing device 100. The rear surface is the opposite surface of the fixing device 100 from the front surface (surface which is on the side from which sheet P is outputted from the fixing device 100). The left side means the left side of the fixing device as seen from the front side of the fixing device. The right side means the right side of the fixing device as seen from the front side of the fixing device 100. "Upstream" means the upstream in terms of the direction in which a sheet of recording medium is conveyed. "Downstream" means the downstream in terms of the recording medium conveyance direction.

Figure 2:
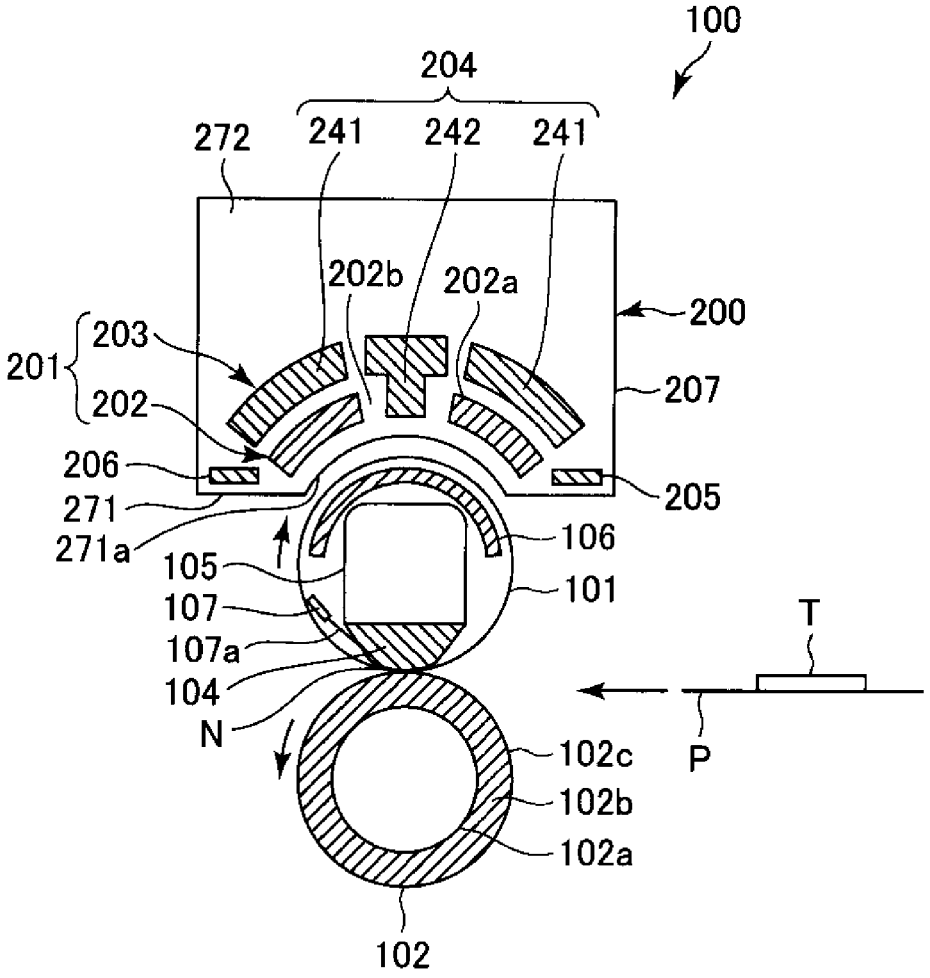
FIG. 2 is a schematic sectional view of the fixing device (apparatus) in the first embodiment of the present invention.

FIG. 2 is a schematic sectional view of the essential portions of the fixing device 100 in this embodiment.

The fixing device 100 has: a fixation belt 101, as a circularly movable heating member (fixing member), which is an endless belt; a pressure roller 102 as a rotatable member (pressure applying member); and an induction heating section 200 as an induction heating means (heat source). The fixation belt 101 has a metallic layer as an induction heat generating member, as will be described later. The pressure roller 102 is kept in contact with the outward surface of the fixation belt 101. On the inward side of the fixation belt 101, with reference to the loop which the fixation belt 101 forms, there is positioned a pressure applying member 104 which forms the fixation nip N by pressing the fixation belt 101 upon the pressure roller 102. The pressure applying member 104 is held by a metallic stay 105. Also on the inward side of the loop which the fixation belt 101 forms, there is a magnetism shielding core 106, as a magnetism blocking member, for preventing the stay 105 from being increased in temperature by the heat generated therein by electromagnetic induction. The magnetism blocking core 106 is on the induction heating section 200 side of the stay 105.

Also on the inward side of the loop which the fixation belt 101, a temperature sensor 107 (temperature detection element) as a temperature detecting means is provided. As the temperature sensor 107, a thermistor or the like is employed. In terms of the lengthwise direction of the fixing device 100, the temperature sensor 107 is positioned at roughly the center of the fixation belt 101, being kept in contact with the inward surface of the fixation belt 101. The temperature sensor 107 is indirectly attached to the pressure applying member 104 with the placement of an elastic supporting member 107*a* between itself and the pressure applying member 104. Thus, even if the surface of the fixation belt 101, with which the temperature sensor 107 is kept in contact, is changed in position by the undulation, or the like movement of the fixation belt 101, the temperature sensor 107 is made to follow the undulation or the like of the fixation belt 101, by the elastic supporting member 107*a*, being thereby enabled to remain satisfactorily in contact with the fixation belt 101.

Figure 3:
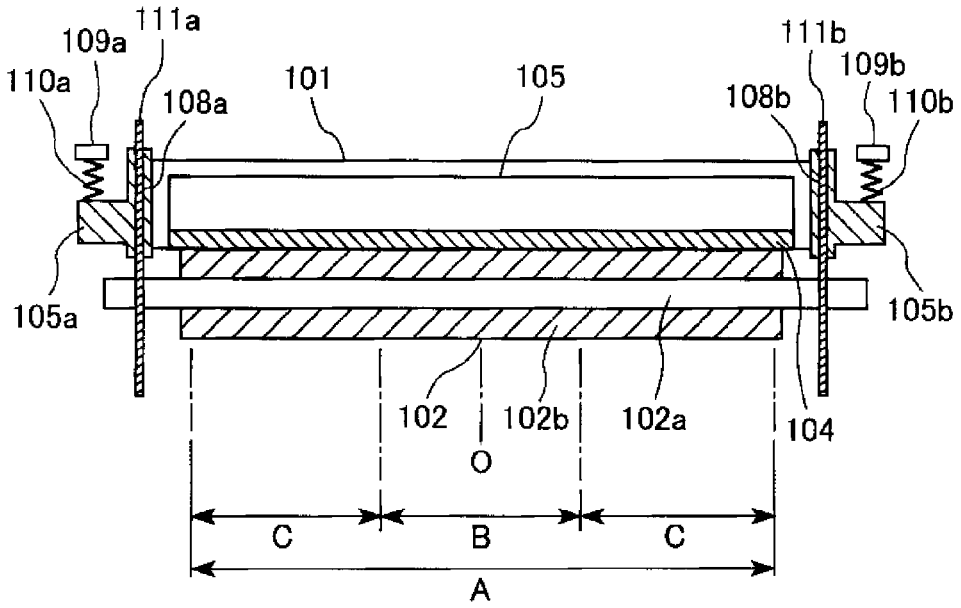
FIG. 3 is a schematic front view of the fixing device in the first embodiment.

FIG. 3 is a schematic sectional view of the essential portions of the fixing device 100 in this embodiment.

The fixing device 100 is provided with left and right fixation flanges 108*a* and 108*b*, which are positioned at the ends of the fixation belt 101 in terms of the lengthwise direction, one for one. The fixation flanges 108*a* and 108*b* are for regulating the fixation belt 101 in the movement of the belt 101 in the lengthwise direction and also, in the shape in terms of the circumferential direction. The stay 105 is positioned on the inward side of the loop which the fixation belt 101 forms, and is put through the left and right fixation flanges 108*a* and 108*b*. There are stay pressing springs 110*a* and 110*b*, which are compression springs as pressure applying means, being kept compressed between lengthwise ends portion 105*a* and 105*b* of the stay 105, and the spring supporting members 109*a* and 109*b* of the chassis of the fixing device 100, respectively. The stay pressing springs 110*a* and 110*b* generate the force which is for causing the stay 105 to press (press downward) the fixation belt 101 upon the pressure roller 102. Therefore, the bottom surface of the pressure applying member 104 held by the stay 105, and the top surface of the pressure roller 102 are pressed against each other, with the presence of the fixation belt 101 between the two surfaces, forming thereby the fixation nip N, which has a preset width in terms of the direction in which a sheet P of recording medium is conveyed. In this embodiment, the fixing device 100 is structured so that the left and right flanges 108*a* and 108*b* contact the metallic core 102*a* of the pressure roller 102 at the lengthwise ends of the metallic core 102*a*, one for one (unshown). Therefore, it is possible to prevent the elastic layer 102*b* of the pressure roller 102 and the fixation belt 101 from being permanently deformed. Further, the fixing device 100 has lateral supporting plates 111*a* and 111*b* for rotatably supporting the fixation belt 101, with the presence of the fixation flanges 110*a* and 110*b* between themselves and fixation belt 101. The fixation belt 101 is regulated in its position in terms of the lengthwise direction of the fixing device 100 by the lateral supporting plates 111*a* and 111*b*, with the presence of the fixation flanges 110*a* and 110*b* between the lateral supporting plates 111*a* and 111*b* and the fixation belt 101. The pressure roller 102 also is rotatably supported by the lateral supporting plates 111*a* and 111*b*, by this metallic core 102*a*, at the lengthwise ends.

Figure 4:
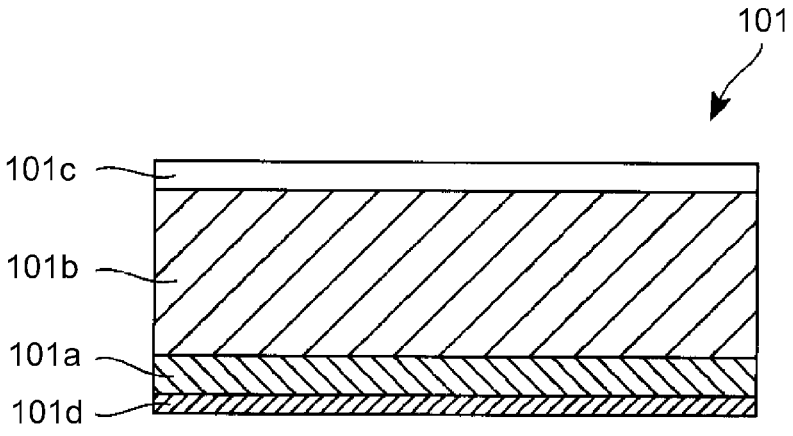
FIG. 4 is a schematic sectional view of the fixation belt of the fixing device in the first embodiment.

FIG. 4 is a schematic sectional view of a part of the fixation belt 101, and shows the laminar structure of the belt 101. The fixation belt 101 has a metallic layer (electrically conductive layer) 101*a*, which is the base layer of the fixation belt 101. As the metallic substances usable as the material for the metallic base layer 101*a*, iron alloy, copper, silver, and the like can be preferably used. From the standpoint of reducing the fixation belt 101 in diameter (reducing fixation belt 101 in thermal capacity) or the like reason, the internal diameter of the metallic layer 101*a* is desired to be in a range of 20 mm-60 mm. In this embodiment, it is 60 mm. From the standpoint of thermal capacity, and the heat generation efficiency by magnetic flux, the thickness of the metallic layer 101*a* is desired to be set to a value in a range of 10 μm~70 μm. In this embodiment, the thickness of the metallic layer 101*a* is 60 μm. The fixation belt 101 has an elastic layer 101*b*, which is on the outward surface of the metallic layer 101*a*. The elastic layer 101*b* is a rubber layer formed of heat resistant rubber. In consideration of the need for reducing the fixation belt 101 in thermal capacity to reduce the length of time (warm-up time) necessary for temperature increase, and also, for satisfactorily fixing a color image, the thickness of the elastic layer 101*b* is desired to be set to a value in a range of 100 μm-800 μm. In this embodiment, the thickness of the elastic layer 101*b* is 100 μm. There is a layer formed of fluorinated resin, as a separating layer 101*c* on the outward surface of the elastic layer 101*b*. As the fluorinated resin, PFA and TTFE, for example, is used. In this embodiment, from the standpoint of thermal conductivity and durability, the thickness of the separation layer 101*c* is desired to be set to a value in a range of 20 μm-200 μm. In this embodiment, the thickness of the separation layer 101*c* is 150 μm. In order to reduce the coefficient of friction between the inward surface of the fixation belt 101 and the temperature sensor 107, there may be provided a highly lubricous layer 101*d*, on the inward side of the metallic layer 101*a*. The thickness of the lubricous layer 101*d* is desired to be set to a value in a range of 10 μm-50 μm.

The pressure roller 102 has: a metallic core 102*a*; a rubber layer as an elastic layer 102*b* which is on the outward surface of the metallic core 102*a*; a parting layer 102*c* as the surface layer which covers the outward surface of the elastic layer 102*b*. In this embodiment, the external diameter of the metallic core 102*a* is 40 mm. The thickness of the elastic layer 102*b* is 20 mm. The thickness of the parting layer 102*c* is 150 μm.

The pressure applying member 104 is formed of heat resistant resin. The stay 105 is required to be rigid to apply pressure to the fixation nip N. In this embodiment, therefore, it is formed of iron. Further, the pressure applying member 104 is very close to the excitation coil 202 of the induction heating section 200, which will be described later, in particular, at the ends in terms of the widthwise direction. Therefore, in order to shield the pressure applying member 104 from the magnetic field generated by the excitation coil 104 to prevent heat from being generated in the pressure applying member 104, there is provided a magnetism blocking core 106 which extends across virtually the entire lengthwise range of the fixing device 100, on the induction heating section 200 side of the pressure applying member 104.

The base layer 101*a* of the fixation belt 101 is formed of a metallic substance. Therefore, what is necessary as the means for regulating the deviation of the fixation belt 101 in the lengthwise direction even while the fixation belt 101 is circularly moved, are nothing but the fixation flange 108*a* and 108*b* which simply catch the end portions of the fixation belt 101 in terms of the lengthwise direction. Therefore, the fixing device 100 can be simplified in structure.

The induction heating section 200 is positioned on the opposite side of the fixation belt 101 from the pressure roller 102, in such a manner that it opposes the pressure roller 102. The induction heating section 200 is positioned roughly in parallel to the lengthwise direction of the fixation belt 101, with the presence of a preset amount of gap between itself and fixation belt 101. The induction heating section 200 heats the fixation belt 101 by heating the metallic layer 101*a* of the fixation belt 101 as an induction heat generating member, by induction heating, from the outward side of the fixation belt 101. The structure and operation of the induction heating section 200 are described later in detail.

Next, the fixation process of the fixing device 100 is described in general terms.

As electric power is supplied to the excitation coil 202 of the induction heating section 200, from an electric power source 103 (FIG. 18), which is under the control of the control section 50 (FIG. 18), the temperature of the fixation belt 101 is increased to a preset level (fixation level), and is kept at the fixation level. The electric power source 103 has an excitation circuit (electromagnetic induction heating driving circuit: high frequency converter), an AC power source, and so on. With the temperature of the fixation belt 101 being kept at the preset fixation level, the sheet P of recording medium, on which an unfixed toner image T is borne, is introduced between the fixation belt 101 and pressure roller 102, in the fixation nip N, while being guided by the guiding member (unshown), in such an attitude that the surface of the sheet P, on which the unfixed toner image T is present, faces the fixation belt 101. Then, the sheet P is moved along with the fixation belt 101 through the fixation nip N, while remaining pinched between the fixation belt 101 and pressure roller 102, being therefore airtightly pressed on the outward surface of the fixation belt 101. Thus, heat is applied to the sheet P and the unfixed toner image T thereon, primarily from the fixation belt 101. Further, the sheet P and the unfixed toner image T thereon are subjected to the pressure applied by the pressure roller 102. Consequently, the unfixed toner image T is fixed to the surface of the sheet P. After being conveyed through the fixation nip N, the sheet P separates itself from the outward surface of the fixation belt 101, because the fixation belt 101 is deformed at the exit portion of the fixation nip N. Then, the sheet P is conveyed out of the fixing device 100.

Here, the measurement of the sheet P of recording medium in terms of the direction roughly perpendicular to the direction in which the sheet P is conveyed is referred to as the width of the sheet P. Regarding where a sheet P of recording medium is positioned relative to the fixing device 100 in terms of the lengthwise direction of the fixing device 100, a sheet P of recording medium is positioned so that the center of the sheet P coincides with the center of the fixing device in terms of the lengthwise direction, regardless of the size of the sheet P. That is, the sheet P is conveyed in the so-called central alignment. A referential code "O" in FIG. 3 stands for the central alignment line (theoretical line) of the fixing device 100. A referential code "A" in FIG. 3 stands for the width of the path of the largest sheet P of recording medium (which may be referred simply as largest sheet P of recording medium), in terms of width, which can be dealt with by the fixing device 100. A referential code "B" in FIG. 3 stands for the width of the path of any sheet P of recording medium (which may be referred to simply as small sheet P of recording medium), in terms of width, which is smaller than the largest sheet P of recording medium. A referential code "C" in FIG. 3 stands for the areas which fall between the edge of the path of the largest sheet P of recording medium and the edge of the small sheet P of recording medium, that is, the areas which are not used for fixation when the small sheet P is used for image formation, or the out-of-sheet-path area.

Figure 18:
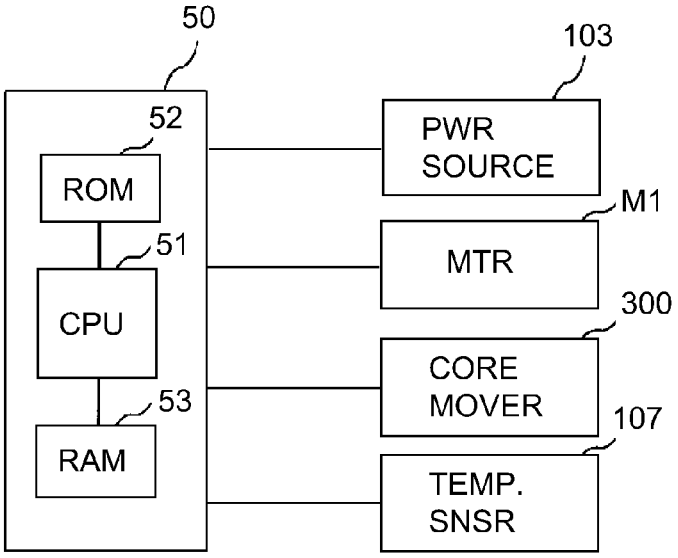
FIG. 18 is a block diagram of the control system of the image forming apparatus in the first embodiment, which is for controlling the portion of the apparatus, to which the present invention is related.

The temperature sensor 107 detects the temperature of roughly the center (which corresponds to abovementioned central referential line O) of the inward surface of the fixation belt 101, in terms of the lengthwise direction, and inputs the information of the detected temperature level into the control section 50 (FIG. 18). That is, regardless of the width of a sheet P of recording medium used for image formation, the temperature sensor 107 contacts the inward surface of the portion of the fixation belt 101, which corresponds in position to the path of the sheet P in use, and detect the temperature of the portion of the fixation belt 101, which corresponds in position to the sheet P in use. The control section 50 controls the electric power to be inputted into the excitation coil 202 of the induction heating section 200 from the electric power source 103 (FIG. 18), in such a manner that the temperature level detected by the temperature sensor 107 remains at the preset target level (fixation level). That is, as the temperature level detected by the temperature sensor 107 increases to the preset fixation level, the electric power which is being supplied to the excitation coil 202 is shut off. In this embodiment, the control section 50 changes, in frequency, the high frequency electric current applied to the excitation coil from the electric power source 103, so that the temperature level detected by the temperature sensor 107 remains roughly stable at 180° C., which is the preset target level (fixation level). In other words, the control section 50 controls the temperature of the fixation belt 101 by controlling the electric power to be inputted into the excitation coil 202.

At least while the image forming apparatus 1 is being used for image formation, the fixation belt 101 is rotated in the direction (clockwise direction) indicated by an arrow mark in FIG. 2, by the friction between the outward surface of the fixation belt 101 and the peripheral surface of the pressure roller 102, which occurs as the pressure roller 102 is rotationally driven in the direction (counterclockwise direction) indicated by an arrow mark in FIG. 2. The pressure roller 102 is rotationally driven by a motor M1 (FIG. 18), as a driving means, which is controlled by the control section 50 (FIG. 18). The fixation belt 101 is rotated at the peripheral velocity which is roughly the same as the speed at which the sheet P of recording medium, which is conveyed from the secondary transfer nip N2 while bearing the unfixed toner image T. In this embodiment, the peripheral velocity of the fixation belt 101 is 200 mm/sec. Thus, it can process 50 sheets P of recording medium if the sheets P are of the size A4. Further, it can process 32 sheets P of recording medium, if the sheets P are of the size A4R.

3. General Structure of Induction Heating Section

Next, the general structure of the induction heating section 200 is described.

Figure 5:
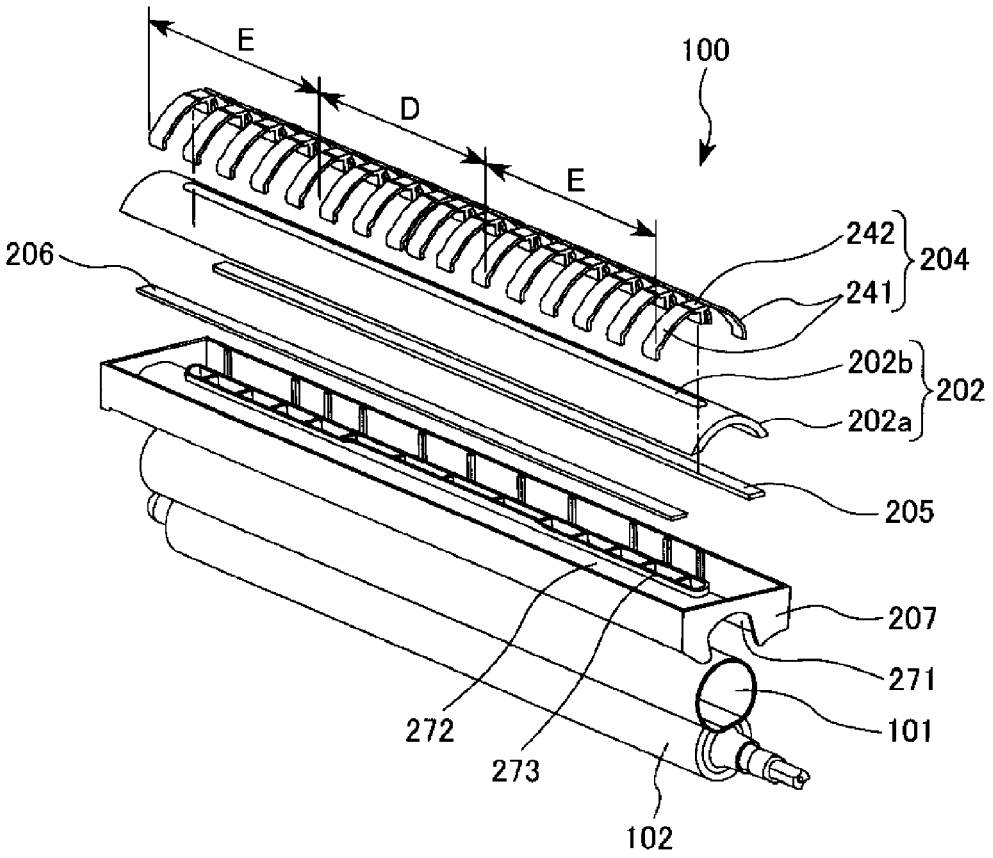
FIG. 5 is an exploded perspective view of the fixing device, in this embodiment, minus the portion which are not directly related to the present invention.

FIG. 5 is an exploded perspective view of the fixing device 100, minus its portions which are not directly related to the present invention. The induction heating section 200 of the fixing device 100 is an induction heating means (heat source) which inductively heats the fixation belt 101 having the metallic layer 101*a* as an induction heat generating member.

The induction heating section 200 has a magnetic flux generating means 201 having the excitation coil 202 and magnetic core 203 (204, 205 and 206). It has also a coil holder (coil holding member) 207 which holds the excitation coil 202.

The excitation coil 202 is formed by winding electric wire roughly in the form of an elliptic (shaped like bottom of boat), the long axis of which is parallel to the lengthwise direction of the fixing device 100. Referring to FIG. 5, a referential code 202*b* stands for the center/top portion of the excitation coil 202, and a referential code 202*a* stands for the wound portion of the excitation coil 202. The overall shape of the excitation coil 202 is such that it is bent in curvature so that the wound portion 202*a* matches in contour a part of the outward surface of the fixation belt 101. The excitation coil 202 is positioned so that it opposes a part of the outward surface of the fixation belt 101. Further, the excitation coil 202 is positioned so that its lengthwise ends oppose the ends of the fixation belt 101 in terms of the lengthwise direction. As the electric wire for the excitation coil 202, Litz wire, for example, is used. The excitation coil 202 is held to the coil holder 207 by being solidly attached to the coil holder 207.

The magnetic core 203 has multiple external magnetic cores 204, which are aligned in parallel in the lengthwise direction of the fixing device 100 with the presence (provision) of preset intervals. Each of the external magnetic cores 204 is in such a shape that it envelops the center portion of the wound portion of the excitation coil 202 (it is roughly in the shape of an arch). That is, the external magnetic core 204 has a portion (portion R), which coincides in position to the outward surface of the wound portion 202*a* of the excitation coil 202. The external magnetic core 204 has a portion (protrusion), which protrudes toward the center portion 202*b* of the wound portion 202*a* of the excitation coil 202, so that it will be in the adjacencies of the metallic layer (induction heat generating member) 101*a* of the fixation belt 101 after the assembly of the fixing device 100. In this embodiment, the magnetic core 203 has 16 external magnetic cores 204, which are aligned in parallel in the lengthwise direction of the fixing device 100, with the placement of roughly the same intervals which are less across the center portion of fixing device 100), from one end of the fixing device 100 to the other (interval between central two cores 204 is less than the others). As will be described later in detail, the fixing device 100 is structured so that at least one of the multiple external magnetic cores 204 is changeable in position relative to the excitation coil 202. Hereafter, the external magnetic core (cores) changeable in position relative to the excitation coil 202 (which will be referred to as movable magnetic core, hereafter) has the first core 241 (end core, arch-shaped core), which opposes the wound portion 202*a* of the excitation coil 202, and the second core 242 (center core, T-shaped core), which has a protrusion 242*a* which protrudes toward the center portion 202*b* of the wound portion 202*a* of the excitation coil 202. The method for holding the external magnetic cores 204 by the coil holder 207 is described later.

The magnetic core 203 has an upstream magnetic core 205, which is on the upstream side of the excitation coil 202, and extends in the lengthwise direction of the fixing device 100. Further, the magnetic core 203 has a downstream magnetic core 206, which is on the downstream side of the excitation coil 202 and extends in the lengthwise direction of the fixing device 100. The upstream and downstream magnetic cores 205 and 206 are held by the coil holder 207 by being solidly attached to the coil holder 207.

The above-described external magnetic core 204 covers the excitation coil 202 in such a manner that the upstream and downstream magnetic cores 205 and 206 make it practically impossible for the magnetic field generated by the excitation coil 202 to leak, except toward the metallic layer 101*a* (induction heat generating member) of the fixation belt 101. Further, the magnetic core 203 plays the role of efficiently guide the alternating magnetic flux generated by the excitation coil 202, to the metallic layer (induction heat generating member) 101*a* of the fixation belt 101. In other words, the magnetic core 203 plays both the role of increasing the magnetic circuit (magnetic path) in efficiency, and the role of blocking the magnetism. As the material for the magnetic core 203, ferrite or the like, which is high in permeability, and low is residual magnetic flux density, is desired.

In this embodiment, each of the upstream and downstream magnetic cores 205 and 206 is a single (one-piece) member which extends in the lengthwise direction of the fixing device 100. However, each of the upstream and downstream magnetic cores 205 and 206 may be made up of multiple sub-cores aligned in the lengthwise direction of the fixing device 100.

The coil holder 207 is formed of dielectric resin. It is in the form of a topless rectangular box. It is positioned so that its lengthwise direction is parallel to the lengthwise direction of the fixing device 100, and also, so that its bottom portion 207 faces the fixation belt 101. The bottom portion 271 has a curved (arch-like) portion 271*a*, which matches in curvature the portion of the fixation belt 101, which corresponds in position to the magnetic blocking core 106. Further, the opposite side of the coil holder 207 from the bottom portion 271 is open as an opening 272. In this embodiment, the coil holder 207 is positioned above the fixation belt 101 in such a manner that it opposes the fixation belt 101, with the presence of a preset amount of gap between the arch-like portion 271*a* of the bottom portion 271, and the outward surface of the fixation belt 101.

When the fixation belt 101 is being rotated, high frequency electric current which is 20 kHz-50 kHz in frequency is applied to the excitation coil 202 of the induction heating section 200, from the electric power source 103 (FIG. 18). Thus, heat is inductively generated in the metallic layer 101*a*, as an induction heat generating member, of the fixation belt 101 by the magnetic field generated by the excitation coil 202, increasing thereby the fixation belt 101 in temperature. That is, the excitation coil 202 is made to generate an alternating magnetic flux by the alternating current supplied by the electric power source 103. This alternating magnetic flux is guided by the magnetic core 203 of the induction heating section 200, and acts on the metallic layer (induction heat generating member) 101*a* of he fixation belt 101, generating eddy current in the metallic layer 101*a*. This eddy current generates Joule's heat in the metallic layer (induction heat generating member) 101*a* of the fixation belt 101, by the amount proportional to the specific resistance of the material of the metallic layer 101*a*. As described above, the metallic layer (induction heat generating member) 101*a* of the fixation belt 101 is made to generate heat in itself by electromagnetic induction; it is made to generate heat by the function of the magnetic flux by supplying the excitation coil 202 with alternating electric current.

In this embodiment, the fixation belt 101 and the excitation coil 202 of the induction heating section 200 are kept electrically insulated from each other by the coil holder 207 which is roughly 2 mm in thickness. The excitation coil 202 is held by the coil holder 207 in such a manner that a roughly preset amount of distance is maintained between the fixation belt 101 and excitation coil 202 to ensure that the fixation belt 101 is roughly uniform in the amount of heat generation. In this embodiment, the temperature of the fixation belt 101 is controlled so that the temperature of the fixation belt 101 detected by the temperature sensor 107 remains roughly stable at 180° C., which is the preset target level (fixation level), as described above. In this embodiment, the induction heating section 200, which includes the excitation coil 202, is positioned outside the loop which the fixation belt 101 forms, instead of the inside of the loop, which becomes higher in temperature than the outside of the loop. Therefore, the excitation coil 202 is unlikely to become excessively high in temperature, being therefore unlikely to increase in electrical resistance. Therefore, it is likely to be less in the amount of loss in terms of Joule's heat which occurs as high frequency electric current is flowed. Further, the positioning of the excitation coil 202 outside the loop, which the fixation belt 101 forms, contribute to reduce the fixation belt 101 in diameter (reduction in thermal capacity). Thus, the fixing device 100 is excellent in terms of energy conservation.

4. External Magnetic Core

Next, the structure of the external magnetic core is described further. As described above, in this embodiment, the multiple external magnetic cores 204 are aligned in parallel in the lengthwise direction (which is roughly perpendicular to conveyance direction of sheet P), with the presence of roughly equal intervals. Each external magnetic core 204 is structured in the form of such an arch that appears as if it surrounds the center of the excitation coil 202 and the adjacencies of the center (roughly in the form of arch). To describe in detail, each external magnetic core 204 has a pair of first cores (end cores, arch-shaped cores) 241, and a single second core (center core, T-shaped core) (hereafter, group of multiple external magnetic cores may be collectively referred to simply as external magnetic core).

In this embodiment, the external magnetic cores, which are within a preset range (movable core range) E (in which external magnetic cores are movable), that is, the lengthwise end ranges of the fixing device 100, are movable magnetic cores, which can be changed in their position relative to the excitation coil 202. In particular, in this embodiment, the five external magnetic cores 204, which are on one of the lengthwise end sides of the fixing device 100, and the five external magnetic cores 20, which are on the other lengthwise end side of the fixing device 100, are the movable magnetic cores. These movable external magnetic cores 204 are movable by a core moving mechanism as a core moving means, as will be described later in detail.

Also in this embodiment, the external magnetic cores 204 which are positioned in a preset range (stationary core range) D (in which external magnetic cores are not movable), which corresponds in position to the center portion of the fixing device 100, are solidly attached to the coil holder 207, as will be described later in detail.

The dimension of the stationary core range D in terms of lengthwise direction equals to the width of a small sheet P of recording medium. The dimension of the combination of the stationary core range D and movable core ranges E equals to the width of the large sheet P of recording medium. That is, in this embodiment, the range D corresponds the range B in FIG. 3, and the range E corresponds to the range C in FIG. 3. Further, the combination of the range D and ranges E corresponds to the range A in FIG. 3.

Figure 6:
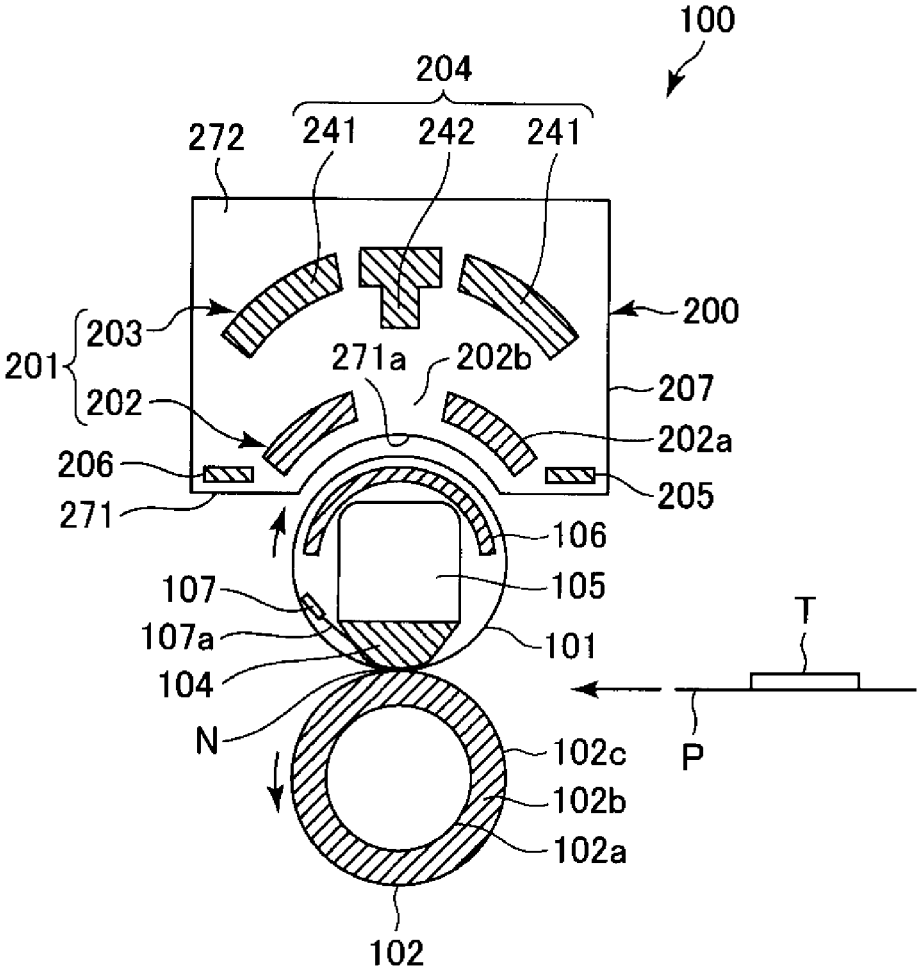
FIG. 6 is a schematic sectional view of the fixing device in the first embodiment.

Although the following will be described later in detail, referring to FIG. 6, the external magnetic cores 204 positioned in the ranges E are enabled to be moved in the direction to move away from the excitation coil 202 so that in the ranges E, the distance between the excitation coil 202 and external magnetic core 204 can be increased. As the distance between the excitation coil 202 and external magnetic core 204 is increased, the magnetic circuit created in the adjacencies of the excitation coil 202 by the magnetic core 203, metallic layer (induction heat generating member) 101*a* of the fixation belt 101, and so on, is reduced in efficiency, and therefore, the fixation belt 101 reduces in the amount of heat it generates. Therefore, the out-of-sheet path portions of the fixation belt 101 are prevented from excessively increasing in temperature. Therefore, the magnetic core 203, excitation coil 202, and so on, are prevented from abnormally increasing in temperature. FIG. 6 is a schematic sectional view of the essential portions of the fixation belt 101 in this embodiment. It shows the state of the essential portions when the external magnetic cores 204 positioned in the ranges E have been moved away from the excitation coil 202.

Figure 23:
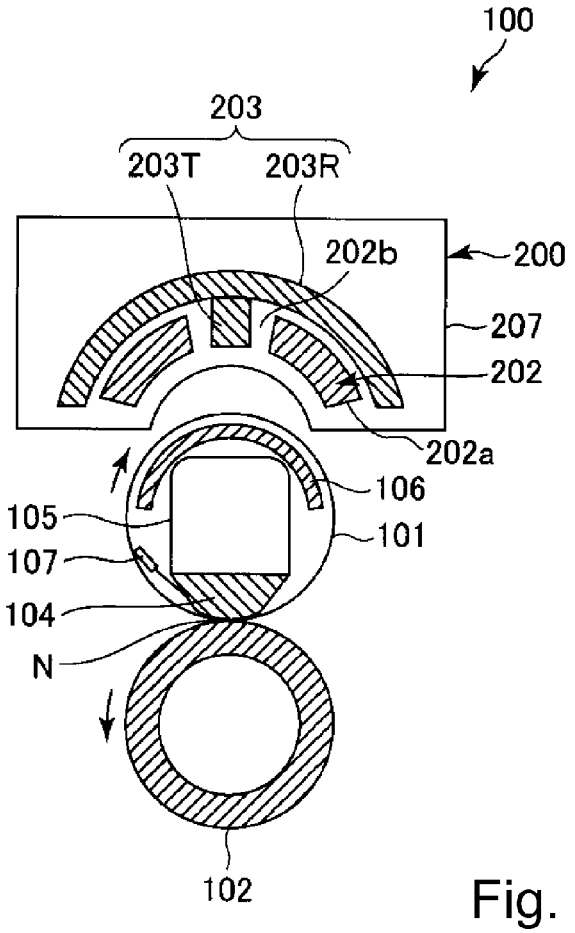
FIG. 23 is a schematic sectional view of a referential fixing device.
Figure 24:
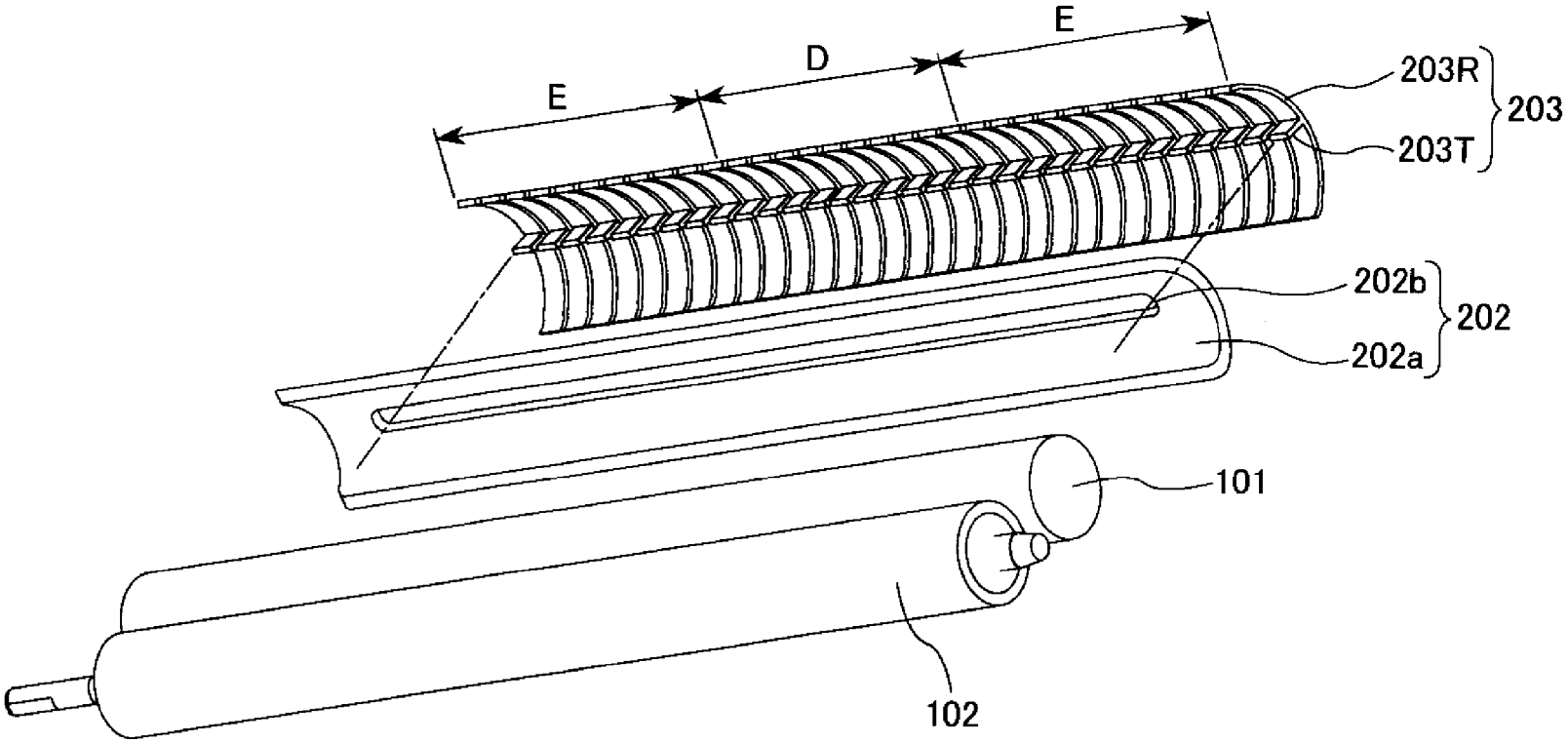
FIG. 24 is an exploded perspective view of the referential fixing device, minus the portions of the device, which are not directly related to the present invention.
Figure 25:
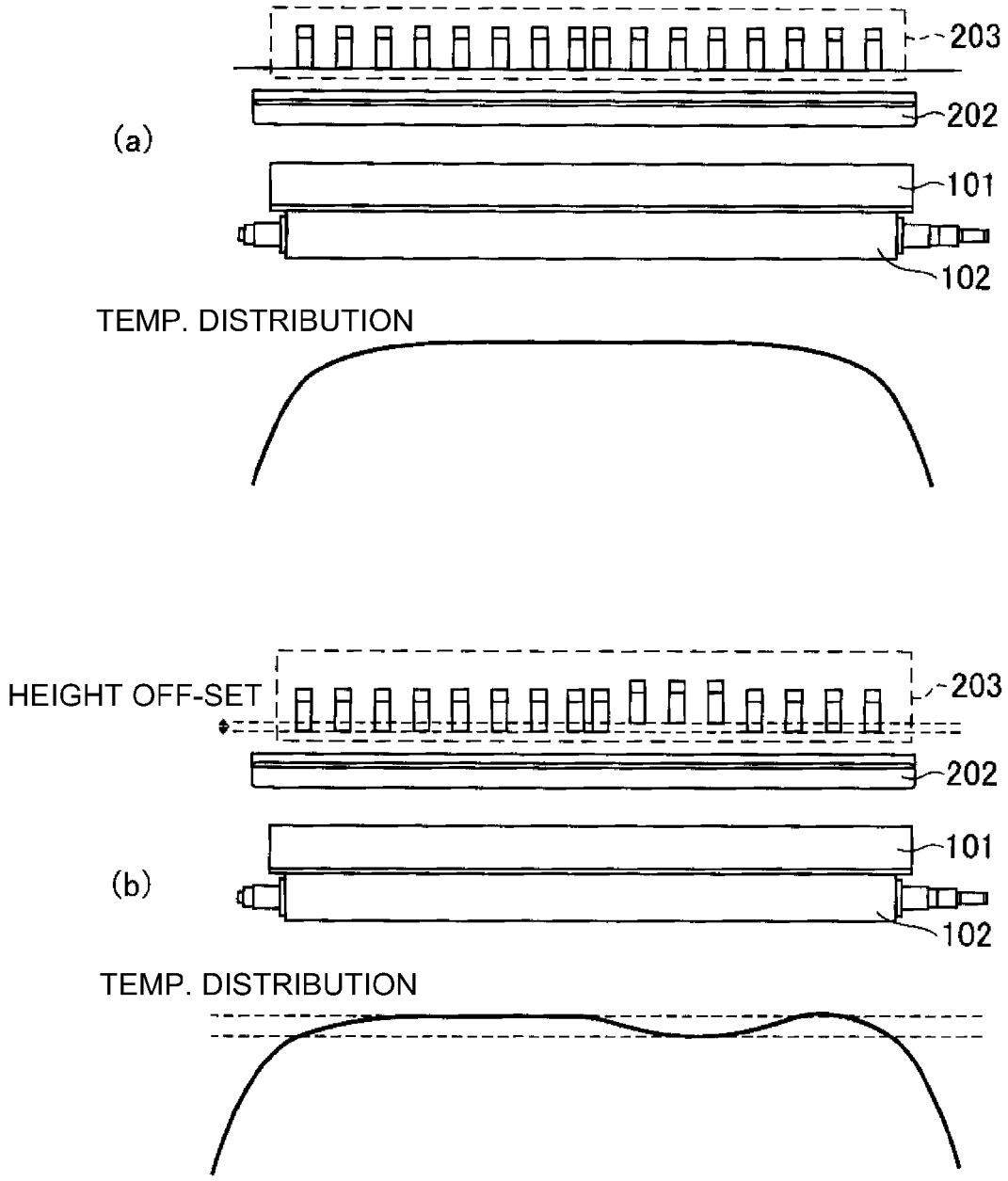
FIG. 25 is a drawing for describing the relationship between the positioning of the magnetic core, and the temperature distribution of the fixation belt, in terms of the lengthwise direction of a fixing device.

Here, referring to FIGS. 23-25, the problems which a fixing device structured so that its magnetic core is moved to reduce its induction heat generating member in the amount of heat generation it generates are described.

FIG. 23 is a schematic sectional view of the essential portions of the referential fixing device. FIG. 24 is an exploded perspective view of the referential fixing device, minus the portions of the apparatus, which are not directly related to the present invention. In the following description of the referential fixing device, the components of the fixing device, their portions, and so on, which correspond in function and structure to the counterparts of the fixing device 100 in this embodiment are given the same referential codes as those given to the counterparts.

Basically, the referential fixing device 100 is similar in structure to the fixing device 100 in this embodiment. In the case of the referential fixing device 100, the magnetic core 203 (which corresponds to group of external magnetic cores 204 in this embodiment) is a one-piece core, unlike the magnetic core 203 in this embodiment, which is made up of multiple external magnetic cores 204 aligned with the presence of preset intervals. That is, in the case of the referential fixing device 100, the magnetic core 203 has a portion 203R which is concentric with the outward surface of the wound portion 202*a* of the excitation coil 202. Further, this magnetic core 203 has a protrusion 203T which protrudes toward the center portion 202*b* of the wound portion 202*a* of the excitation coil 202, and is in the adjacencies of the metallic layer (induction heat generating member) 101*a* of the fixation belt 101. Further, the R-portion 203R and protrusion 203T are integral parts of the magnetic core 203. Further, the referential fixing device 100 is not provided with such cores that correspond to the upstream and downstream magnetic cores 205 and 206 with which the fixing device 100 in this embodiment are provided. However, the description of the referential fixing device 100, which will be given next, holds true even if the referential fixing device 100 is provided with the upstream and downstream magnetic cores 205 and 206.

From the standpoint of increasing the fixing device 100 in the efficiency with which heat is generated in the metallic layer (induction heat generating member) 101*a* of the fixation belt 101, by the magnetic flux generating means 201 of the induction heating section 200, it is effective to place the magnetic core 203 as close as possible to the excitation coil 202 of the magnetic flux generating means 201. It is also effective to reduce the distance between the protrusion 203T of the magnetic core 203 and the metallic layer (induction heat generating member) 101*a* of the fixation belt 101.

However, if the distance between the excitation coil 202 and magnetic core 203 is reduced, the heat generation efficiency of the induction heating section 200 becomes excessively sensitive to the positional relationship among the magnetic core 203, excitation coil 202, and metallic layer (induction heat generating member) 101*a* of the fixation belt 101.

FIG. 25 is a drawing for describing the relationship between the position of the magnetic core 203 and the temperature distribution (heat generation distribution) of the fixation belt 101 in terms of the lengthwise direction. FIG. 25(*a*) shows the relationship between the desirable temperature distribution and the position of the magnetic core 203, and FIG. 25(*b*) shows the relationship between the problematic temperature distribution and the position of the magnetic core 203.

If the multiple magnetic cores 203 aligned in parallel in the lengthwise direction of the fixing device 100 become different in their positional relationship relative to the excitation coil 202 and fixation belt 101, the fixation belt 101 is likely to become nonuniform in temperature. In particular, the positional deviation of the protrusion 203T of the magnetic core 203 relative to the metallic layer (induction heat generating member) 101*a* of the fixation belt 101 (in height direction of drawing) has notable effect upon the nonuniformity of the fixation belt 101 in terms of the temperature distribution in the lengthwise direction.

From the standpoint of making the fixation belt 101 uniform in temperature in the lengthwise direction, it is desired that the following measure is taken. That is, referring to FIG. 25(*a*), the multiple magnetic cores 203 aligned in parallel in the lengthwise direction of the fixing device 100 are individually controlled in terms of their positional relationship relative to the excitation coil 202 and fixation belt 101. More specifically, it is desired that the magnetic cores 203 are rendered the same in the position (in height direction in drawing) of their protrusion 203T relative to the metallic layer (induction heat generating member) 101*a*, in terms of the lengthwise direction. It is also desired that the R portion 203R, and the outward surface of the excitation coil 202, which the R portion 203R opposes, are concentric.

In the case of the above-described referential fixing device 100, the magnetic cores 203 positioned in the movable core ranges E are movable to the first positions which are their closest positions to the excitation coil 202, and the second positions which are their farthest positions from the excitation coil 202. In this case, in order to keep the fixation belt 101 roughly uniform in temperature in terms of the lengthwise direction, it is possible to place the magnetic cores 203 in contact with the coil holder 207 to accurately position the magnetic cores 203.

However, if an attempt is made to place the magnetic cores 203 in contact with the coil holder 207, and move the magnetic cores 203 from their second positions to their first positions, it is possible that the magnetic cores 203 will be damaged by the impact which occurs as the magnetic cores 203 are placed in contact with the coil holder 207. In particular, in the case of the referential fixing device 100, the R portion 203R and protrusion 203T of the magnetic core, which are integral parts of the magnetic core 203, the impact caused by the movement of the magnetic core 203 is entirely caught by the protrusion 203T. Therefore, it is very likely for the magnetic core 203 (protrusion 203T) to be damaged. Generally, the magnetic core 203 is made of ferrite or the like, by sintering ferrite powder or the like,. Thus, it is relatively susceptible to impact.

5. Core Holder

Figure 7:
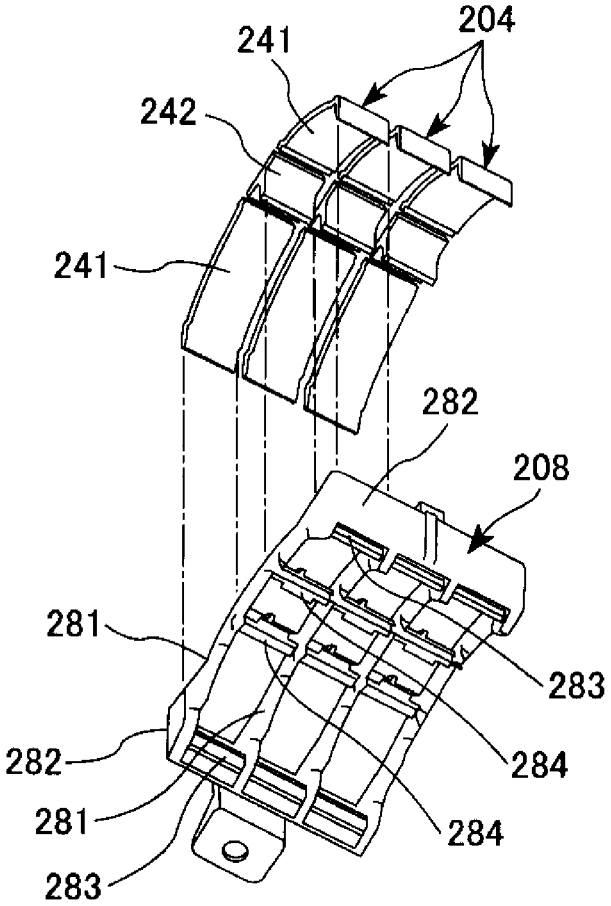
FIG. 7 is an exploded perspective view of the movable magnetic core and core holder in the first embodiment.
Figure 8:
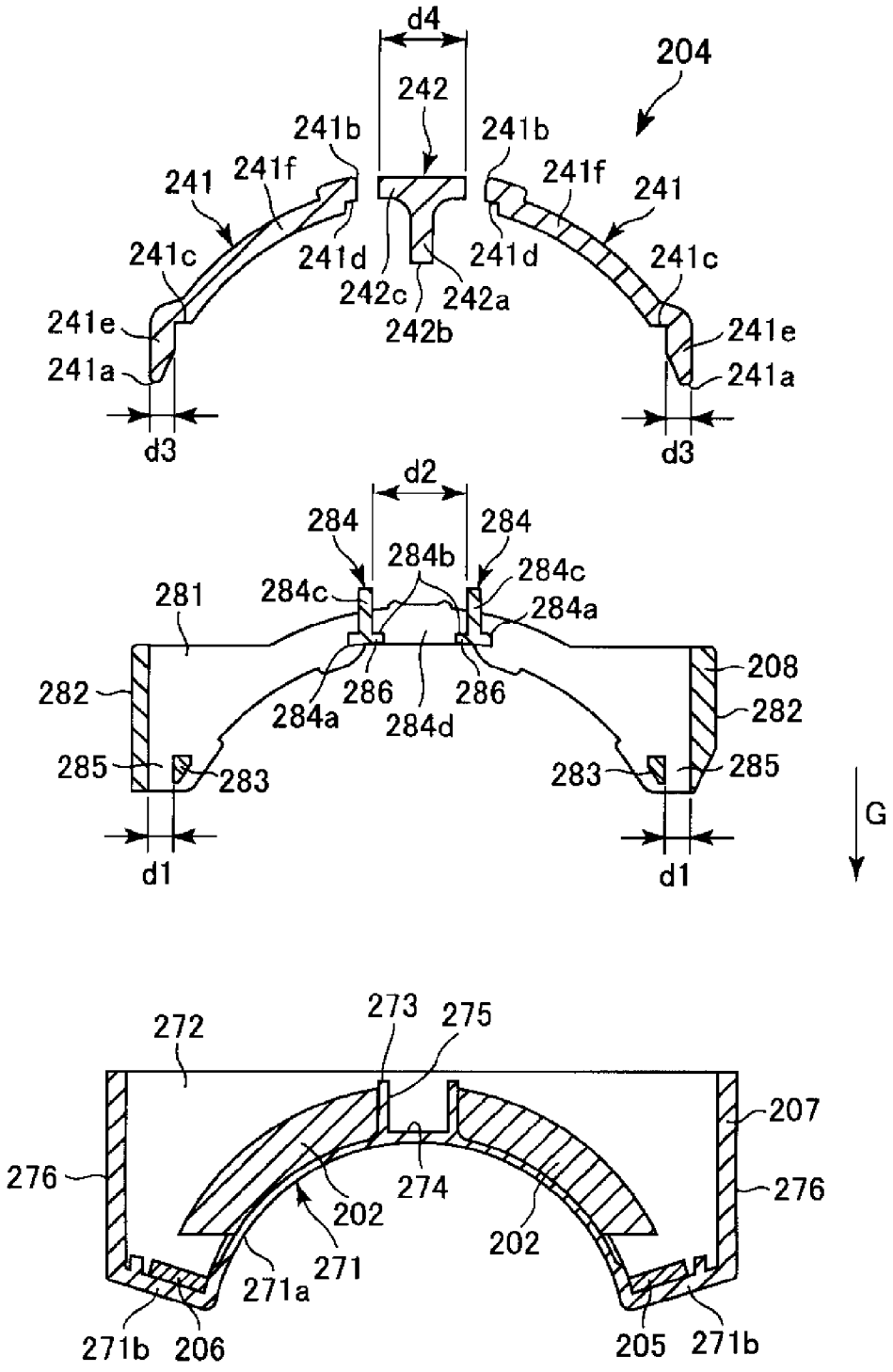
FIG. 8 is an exploded sectional view of the movable magnetic core, core holder, and coil holder in the first embodiment.
Figure 9:
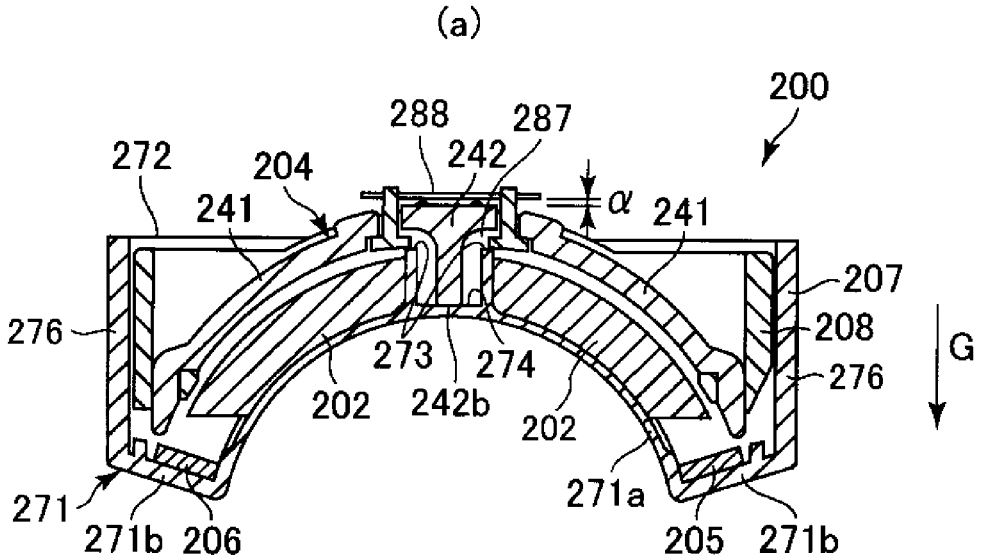
FIG. 9 is a sectional view of the core holder and coil holder in the first embodiment, and shows the positional relationship between the core holder and coil holder, when the core holder is in the first and second positions.
Figure 9:
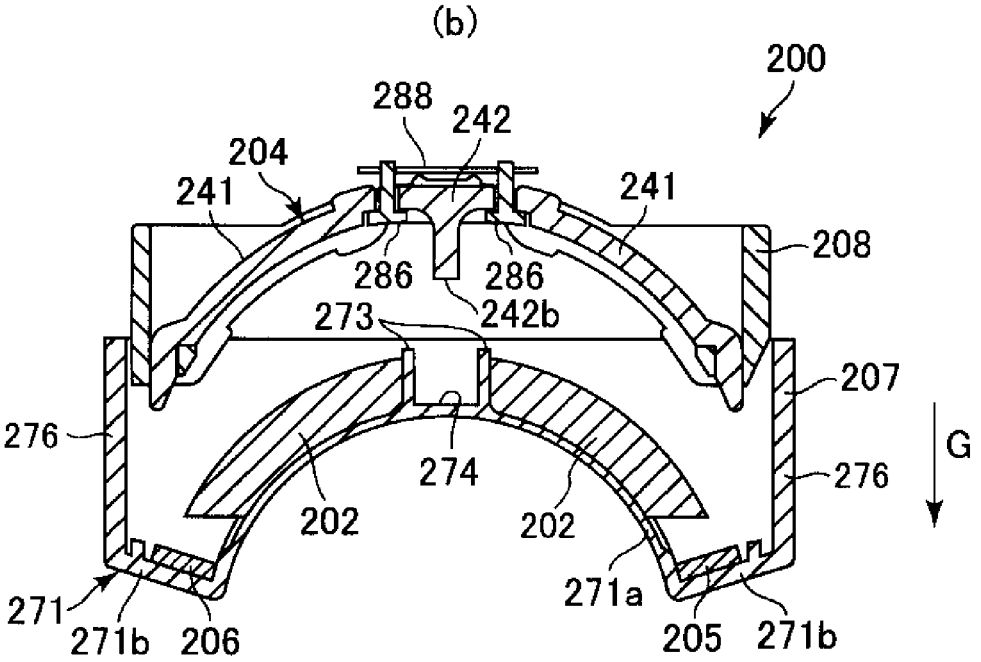

Next, referring to FIGS. 7-9, the core holder (core holding member) 208 for holding the movable magnetic core 204, that is, the external magnetic cores 204 positioned in the movable core ranges E, is described.

FIG. 7 is an exploded perspective view of the external magnetic cores 204 and core holder 208 positioned in the movable core ranges E. FIG. 8 is an exploded sectional view of the external magnetic cores 204, core holder 208, and coil holder 207, which are positioned in the ranges E. FIGS. 9(*a*) and 9(*b*) are schematic sectional views of the core holder 208 and coil holder 207, when the core holder 208 is in the first and second positions, respectively, which will be described later.

In order to deal with the above described problem, in this embodiment, such a structural arrangement that at least the movable magnetic cores 204, that is, the magnetic cores 204 positioned in the movable core range E, are separated as follows. That is, the first core 241 which opposes the wound portion 202*a* of the excitation coil 202, and the second core 242 which has the protrusion 242*a* which protrudes toward the center portion 202*b* of the excitation coil 202, are made physically independent from each other. The movable magnetic cores, that is, the external magnetic cores 204 positioned in the movable core range E, is held by the core holder 208. The core holder 208 enables the first and second cores 241 and 242 it holds, to be moved to the first position which is relatively close to the excitation coil 202, and the second position which is farther from the excitation coil 202 than the first position. Further, as the core holder 208 moves from the second position to the first position, the core holder 208 comes into contact with the first area 273 of contact of the coil holder 207, being enabled to accurately position the first core 241 held by the core holder 208, relative to the excitation coil 202. Further, as the core holder 208 is moved from the second position to the first position, the second core 242 of the external magnetic core 204 held by the core holder 208 comes into contact with the second area 274 of contact of the coil holder 207, being thereby accurately positioned relative to the excitation coil 202. In this embodiment, in order to ensure that the first area 273 of contact moves through the center (hole) of the excitation coil 202, it is formed as the tip of the protrusion 275 which protrudes from the bottom portion 271 of the coil holder 207 in the opposite direction from the fixation belt 101. Further, in this embodiment, the second area 274 of contact is a part of the bottom portion 271 of the coil holder 207, which opposes the center of the wound portion of the excitation coil 202. Further, in this embodiment, the tip 242*b* of the protrusion 242*a* of the second core 242 comes into contact with the second area 274 of contact of the coil holder 207. Next, the abovementioned described structural arrangements are described in detail.

In this embodiment, the combination of the external magnetic cores 204 has a preset width in terms of the lengthwise direction of the fixing device 100, and is shaped so that it appears roughly arched in cross section at a plane which is roughly perpendicular to the lengthwise direction of the fixing device 100. The first cores 241 and 241 of the external magnetic core 204 extend from their base portion s 241*a* and 241*a* which are the lengthwise ends of the aforementioned roughly arched figures, toward the top portions 241*b* and 241*b*, which correspond to the peak of the abovementioned roughly arched figure, in a curvature that is the same as the curvature of the excitation coil 202. More specifically, preset ranges of the base portions 241*a* and 241*a* of the first cores 241 and 241 are areas 241*e* and 241*e* of engagement, which are roughly flat and extend toward the excitation coil 202. The portion of the first core 241, which is between the area 241*e* of engagement and the top portion 241*b* is the arched portion 241*f*. Further, the surface of each first core 241, which faces the excitation coil 202 is provided with the first step-shaped portion 241*c*, which is between the area 241*e* of engagement and arched portion 241*f*. Further, the surface of the each first core 214, which faces the external magnetic core 204, is provided with the second step-like portion 241*d*, which is adjacent to the top portion 241*b*.

The second core 242 of the external magnetic core 204 has a base portion 242*c*, which is roughly flat and makes up the top portion of the abovementioned roughly arched figure, and a protrusion 242*c* which protrudes toward the center portion of the wound portion 202*a* of the excitation coil 202, from the base portion 242*c*. That is, the second core 242 is roughly T-shaped in cross section which is roughly perpendicular to the lengthwise direction of the fixing device 100.

Referring to FIGS. 7 and 9, the external magnetic core 204 shaped as described above is attached to the core holder 208. By the way, FIG. 7 shows one of the core holders 208 aligned in parallel in the lengthwise direction of the fixing device 100. Each core holder 208 holds three of the external magnetic cores 204 aligned in parallel in the lengthwise direction of the fixing device 100. However, the fixing device 100 may be structured so that each core holder 208 holds only one external magnetic core 204, and/or two or more external magnetic cores 204 are held by a single holder 208. Hereafter, the core holder 208 is described, with special attention being paid to the portion of the core holder 208, which holds one of the three external magnetic cores 204 which each core holder 208 can hold.

The core holder 208 is structured like a frame. Each section of the core holder 208, which holds one external magnetic core, has a pair of long lateral portions 281 and 281, which oppose each other and extend in the widthwise direction of the fixing device 100, and short lateral portions 282 and 282, which oppose each other and extend in the lengthwise direction of the fixing device 100. In this embodiment, the end portion of the long lateral portions 281, which is on the excitation coil 202 side, is provided with a void for accommodating the arched portion 272*a* of the bottom portion 271 of the coil holder 207. Each of the pair of short lateral portions 282 and 282 is roughly in the form of a rectangle. The core holder 208 is also provided with first and second bridge beams 283 and 283, and second bridge beams 284 and 284, which bridge between the pair of the long lateral portions 281 and 281. In terms of the widthwise direction of the fixing device 100, the first bridge beams 283 and 283 are positioned roughly at the center between the pair of long lateral portions 281 and 281, with the presence of a preset gap (d2) between the first bridge beams 283 and 283. The second bridge beams 284 and 284 have the core supporting first portion 284*a* and 284*a*, which protrude from the excitation coil 202 side end of the second bridge beams 284 and 284, toward the short lateral portion 282. Further, the excitation coil side of the second bridge beams 284 and 284 have the core supporting second portion 284*b* 284*b*, which protrude in the opposite direction from the direction in which the coil supporting first portion 284*a* and 284*a*. Further, the second bridge beams 284 and 284 have portions 284*c* and 284*c* of engagement which extend from the end portions which have the core supporting second portion 284*b* and 284*b*. The core holder 208 is formed of a dielectric resin.

In this embodiment, referring to FIG. 8, the first core 241 and 241 are attached to the core holder 208, as if it is dropped into the core holder 208 from the top side of the core holder (opposite side from excitation coil 202), as indicated by an arrow mark G. That is, the engagement portions 241*e* and 241*e*, with which the base portions 241*a* and 241*a* of the first cores 241 and 241 are provided, one for one, are fitted into the gap (groove) 285 and 285 provided between the short lateral portions 281 and 281 and first bridge beams 283 and 283 of the core holder 208, one for one. The amount d1 of the gap 285, and the thickness d3 of the engaging portion 241*e*, are roughly the same. The first step-like portion 241*c* of each first core 241 is placed in contact with the top surface of the bridge beam 283 with which the core holder 208 is provided. In this state, each first step-like portion is solidly attached, as solidly attaching means, to the bridge beam 283 by thermal welding. Further, the second step-like portions 241*d* of each first core 241 is placed in contact with the top surface of the core supporting first portion 284, with which the second bridge beam 284 of the core holder 208 is provided, In this state, the second step-like portion 241*d* is solidly attached to the second bridge beam 284 by thermal welding as a means for solidly attaching the second step-like portion 241*d*. Through above described steps, the pair of second bridge beams 214*d* and 214*d* are solidly attached to the core holder 208, being thereby held by the core holder 208. The choice of the solidly attaching means is optional. That is, welding, gluing, binding, snap-fitting, or the like may be used as the solidly attaching means.

Referring to FIG. 8, in this embodiment, the second core 242 also is attached to the core holder 208 as if it is dropped into the core holder 208, from above (from opposite side from excitation coil 202), as indicated by the arrow mark G. That is, the second core 242 is inserted into the gap 284*d* between the second bridge beams 284 and 284 of the core holder 208, from the tip 242*b* side of its protrusion 242*a*. The gap d2 between the pair of engagement portions 284*c* and 284*c* is made slightly larger than the distance d4 between the pair of engagement portions 284*c* and 284*c*, providing thereby a certain amount of play for allowing the base portion 242*c* to easily move. On the other hand, the gap between the second core supporting portions 284*b* and 284*b* of the second bridge beams 284 and 284 is made smaller than the width of the base portion 242*c* of the second core 242, in the same direction. Therefore, the second core 242 can be suspended by the second bridge beams 284 and 284, with the bottom surface of the base portion 242*c* being in contact with the top surface of the second core supporting portions 284*b* and 284*b* of the second bridge beams 284 and 284 of the core holder 208. The second core 242 is not solidly attached to the core holder 208, being therefore allowed to freely move in the direction indicated by the arrow mark G, and also, in the opposite direction from the direction indicated by the arrow mark G, while remaining in the space (gap) 284*d* between the second bridge beams 284 and 284.

In this embodiment, the core holder 208 which is holding the external magnetic core 204 attached to the core holder 208 as described above is placed in the coil holder 207 from the top side (opposite side from excitation coil 202) in the direction indicated by the arrow mark G in FIG. 8, as if it is dropped into the coil holder 207. As will be described later, the core holder 208 can be slid into the coil holder 207 by the core moving mechanism, as core moving means, in the direction indicated by the arrow mark G in FIG. 8, or the opposite direction from the direction indicated by the arrow mark G, and can be positioned in the first position (FIG. 9(*a*)), and the second position (FIG. 9(*b*)). As described above, the coil holder 207 is shaped like a rectangular box without a lid, the lengthwise direction of which is parallel to the lengthwise direction of the fixing device 100. The bottom portion 271 of the coil holder 207 has a semi-cylindrical recess, which arches inward of the coil holder 207, in such a curvature that matches the curvature of the outward surface of the fixation belt 101. The opposite side of the coil holder 207 from the bottom portion 271 is open, as an opening 272. The distance between the pair of long lateral walls 276 and 276 of the coil holder 207, which extend in the lengthwise direction of the fixing device 100, is made slightly greater than the distance between the widthwise portions 282 and 282 of the core holder 208, providing thereby a gap (play), between the core holder 208 and coil holder 207, which is sufficient to allow the core holder 208 to move within the coil holder 207.

The excitation coil 202 is solidly attached to the coil holder 207, being thereby held by the coil holder 207, in such a manner that the contour of the bottom side of the excitation coil 202 matches the contour of the semi-cylindrical portion 271*a* of the bottom portion 271 of the coil holder 207, with the presence of virtually no gap between the excitation coil 202 and cylindrical portion 271*a*. The coil holder 207 has the protrusion 275 which protrudes from the arched portion 271*a* of the bottom portion 271 in the opposite direction from the fixation belt 101 so that it penetrates through the center portion (hole) 202*b* of the wound portion 202*a* of the excitation coil 202. The opposite end of the protrusion 275 from the fixation belt 101 protrudes beyond the outward surface of the wound portion 202*a* of the excitation coil 202. This end of the protrusion 275 is the first area 273 of contact, with which the core holder 208 comes into contact. This first area 273 of contact comes into contact with the catching portions 286 and 286, which are the bottom surface of the second core supporting portions 284*b* and 284*b* of the second bridge beams 284 and 284 of the core holder 208. Further, the arch portion 271*a* of the bottom portion 271, which is on the inward side of the protrusion 275 (which corresponds in position to the center portion 202*b* of excitation coil 202) is the second area 274 of contact, which comes into contact with the second core 242 of the external magnetic core 204. This second area 274 of contact comes into contact with the tip of the protrusion 242*a* of the second core 242 of the external magnetic core 204. Further, it is on the flat portions 271*b* and 271*b*, which are roughly flat portions of the bottom portion 271, which are between the long lateral walls 276 and 276 and bottom portion 271, that the upstream and downstream magnetic cores 205 and 206 are positioned. The upstream and downstream magnetic cores 205 and 206 are solidly attached to the coil holder 207 by thermal welding as solidly attaching means.

Referring to FIG. 5, in this embodiment, the stationary external magnetic core 204, that is, the magnetic core positioned in the stationary core range D, is also made up of the first and second cores 241 and 242, which are physically separated from each other. That is, in this embodiment, all the external magnetic cores 204 are practically the same in structure, dimension, and shape. However, the stationary external magnetic core 204 positioned in the stationary core range D is solidly attached to the coil holder 207. In this embodiment, the external magnetic core 204, which is a stationary magnetic core positioned in the range D, is solidly attached to the coil holder 207, with the placement of a stationary core holder between the external magnetic core 204 and coil holder 207. This stationary core holder is similar in structure to the above described core holder in terms of the method for holding the external magnetic core 204. However, it is solidly attached to the core holder 208 so that it cannot be moved out of the first position. By the way, the stationary external magnetic core 204 positioned in the range D may be directly and solidly attached to the coil holder 207.

Next, referring to FIGS. 9(*a*) and 9(*b*), the positional relationship among the first and second cores 241 and 242 of the external magnetic core 204, and the excitation coil 202, is described.

Referring to FIG. 9(*a*), when the core holder 208 is in the first position, the catching portions 286 and 286 with which the second bridge beams 284 and 284 of the core holder 208 are provided are in contact with the first areas 273 and 273 of the protrusions 275 and 275 of the coil holder 207. Therefore, the first core 241 of the external magnetic core 204 held by the core holder 208 is roughly concentrically positioned with the outward surface of the wound portion 202*a* of the excitation coil 202, with the presence of the core holder 208 and coil holder 207 between the external magnetic core 204 and excitation coil 202.

Here, referring to FIG. 5, the distance between the first area 273 of contact and the metallic layer (induction heat generating member) 101*a* of the fixation belt 101, is roughly uniform across the entire range of the coil holder 207 which extends in the lengthwise direction of the fixing device 100. Further, the core holders 208 by which the multiple external magnetic cores 204 positioned in the movable core ranges E are held, one for one, are practically the same in structure. Therefore, all the first cores 241 of the multiple external magnetic cores 204 positioned in the movable core ranges E are roughly concentrically positioned with the outward surface of the wound portion 202*a* of the excitation coil 202. Further, as described above, in this embodiment, the first core 241 of each of the multiple external magnetic cores 204 positioned in the range D is attached to the coil holder 207 with the placement of a stationary core holder which is similar in structure to the above described core holder 208, between the first core 241 and coil holder 207. Therefore, the first core 241 of each of the multiple external magnetic cores 204 aligned in parallel in the lengthwise direction of the fixing device 100, in the ranges E and D is roughly concentrically positioned with the outward surface of the wound portion 202*a* of the excitation coil 202.

On the other hand, when the core holder 208 is in the first position, there is a gap (space) 287 between the bottom surface of the base portion 242*c* of the second core of the external magnetic core 204, and the top surface of the second core supporting portions 284*b* and 284*b* of the core holder 208, in terms of the direction indicated by the arrow mark G in FIG. 9(*a*). Further, the tip 242*b* of the protrusion 242*a* is in contact with the second area 274 of contact, with which the coil holder 207, keeping the second core 242 in the state shown in FIG. 9(*a*). Further, the protrusion 242*a* of the second core 242 is the center portion (hole) 202*b* of the wound portion 202*a* of the excitation coil 202. Further, the base portion 242*c* of the second core 242 makes up a part of the arch which the curved portion 241*f* of the first core 241 forms with the base portion 242*c*, and which is roughly the same in curvature as the excitation coil 202.

Here, referring to FIG. 5, there is a certain amount of distance between the second area 274 of contact and the metallic layer (induction heat generating member) 101*a* of the fixation belt 101, which is roughly uniform across the entire range of the coil holder 207 in terms of the lengthwise direction of the fixing device 100. Therefore, the second core 242 of each of the multiple external magnetic cores 204 positioned in parallel in the lengthwise direction of the fixing device 100, along the second area 274 of contact of the coil holder 207, in the movable core range E is positioned roughly the same distance from the metallic layer (induction heat generating member) 101*a* of the fixing device 100 as the other second cores 242. Further, as described above, in this embodiment, the multiple external magnetic cores 204 positioned in parallel in the lengthwise direction of the fixing device 100, in the stationary core range D, are solidly attached to the coil holder 207, with the placement of the stationary core holder which is similar in structure as the above described core holder 208, between the external magnetic cores 204 and the coil holder 207. Therefore, the second core 242 of each of the multiple external magnetic cores 204 positioned in parallel in the lengthwise direction of the fixing device 100, along the second area 274 of contact of the coil holder 207, in the ranges E and D is positioned roughly the same distance from the metallic layer (induction heat generating member) 101*a* of the fixing device 100 as the other second cores 242.

As described above, this embodiment of the present invention makes it possible to make roughly uniform the positional relationship among the first and second cores 241 and 242 of the multiple external magnetic cores 204, excitation coil 202, and the metallic layer (induction heat generating member) 101*a* of the fixation belt 101, in terms of the lengthwise direction of the fixing device 100. Therefore, it can make the fixation belt 101 of the fixing device 100 roughly uniform in temperature, in terms of the lengthwise direction of the fixing device 100.

Further, referring to FIG. 9(*a*), when the core holder 208 is in the second position, the catching portions 286 and 286, with which the second bridge beams 284 and 284 are provided are separated from the first area of contact with which the protrusion 275 of the coil holder 207 is provided. Further, the first core 241 of the external magnetic cores 204 held by the core holder 208 are positioned farther from the excitation coil 202 than when the core holder 208 is in the first position. Also when the core holder 208 is in the second position, the second core 242 of the external magnetic core 204 is suspended by the second core supporting portion (holding portions) 284*b* and 284*b*, with which the second bridge beams 284 and 284 of the core holder 208, with the bottom surface of the base portion 242*c* of the second core 242 being in engagement with the top surface of the second core supporting portions (holding portions) 284*b* and 284*b*. Thus, the second core 242 held by the core holder 208 as described above is positioned farther away from the excitation coil 202 than when the core holder 208 is in the first position. Also when the core holder 208 is in the second position, the protrusion 242*a* of the second core 242 is outside the center portion (hole) 202*b* of the wound portion 202*a* of the excitation coil 202.

As described above, in this embodiment, the external magnetic cores 204, which are the movable magnetic cores positioned in the movable core ranges E, are movable to their closest positions to the excitation coil 202, and their farthest positions from the excitation coil 202. When the core holder 208 is in the first position, the external magnetic cores 204, which are movable magnetic cores, are positioned in their closest position to the excitation coil 202. Further, the theoretical circle, which coincides with the first core 241, is concentric with the theoretical circle which coincides with the outward surface of the wound portion 202*a* of the excitation coil 202, and also, the protrusions 242*a* of the second cores 242 are positioned in the center portion (hole) of the excitation coil 202. Also when the core holder 208 is in the second position, the external magnetic cores 204 which are movable magnetic cores are positioned in their farthest position from the excitation coil 202. Further, as the core holder 208 is moved into the second position, the first core 241 is moved in the radius direction of the excitation coil 202 so that it is positioned on the outward side of the excitation coil 202, and not only is the theoretical circle which coincides with the first core 241 displaced from the theoretical circle which coincides with the outward surface of the wound portion of the excitation coil 202, but also, the protrusion 242 of the second core 242 is placed outside the center portion (hole) of the wound portion of the excitation coil 202.

Also in this embodiment, the core holder 208 has a blocker sheet (disengagement preventing portion) 288, which is attached to the adjacencies of the tips of the second bridge beams 284 and 284 to bridge between the second bridge beams 284 and 284. The blocker sheet 288 is positioned on the opposite side of the second core 242 from the fixation belt 101 (inductive heat generating member), and plays a role of preventing the second core 242 from moving in the opposite direction from the fixation belt 101 (that is, inductive heat generating member), more than a preset distance (α). Therefore, when the core holder 208 is moved from the second position to the first position, the second core 242 of the external magnetic core 204 is prevented from moving in the opposite direction from the direction indicated by the arrow mark G in FIG. 9(*a*), far enough to become disengaged from the core holder 208. As the material for the blocker sheet 288, aramid polymer fiber which is heat resistant, heat resistant paper, or the like can be preferably used. Further, in this embodiment, each disengagement prevention sheet 288 is thermally welded to the core holder 208 at two points.

As described above, when the core holder 208 is in the first position, the tip 242*b* of the protrusion 242*a* of the second core 242 of the external magnetic core 204 is in contact with the second area 274 of contact of the coil holder 207. Further, the gap (space) 287 is present between the bottom surface of the base portion 242*c* of the second core 242, and the second core supporting portion 284*b* and 284*b* of the core holder 208. In this embodiment, therefore, when the core holder 208 is in the first position, there is the preset amount of clearance between the second core 242 and disengagement prevention sheet 288. Therefore, it can be prevented that the second core 242 comes into contact with the disengagement prevention sheet 288, whereby the core holder 208 is lifted in the opposite direction from the direction indicated by the arrow mark G in FIG. 9(*a*).

According to this embodiment, it is possible to reduce the impact to which the external magnetic core 204 positioned in the movable core range E is subjected when it is moved from its farthest position from the excitation coil 202, to its closet position to the excitation coil 202.

That is, when the core holder 208 is moved from the second position to the first position, the catching portions 286 and 286 of the core holder 208 come first into contact with the first area 273 of contact of the coil holder 207, whereby the first core 241 of the external magnetic core 204 is accurately positioned relative to the excitation coil 202. Therefore, it does not occur that the first core 241 comes directly in contact with the coil holder 207. Therefore, it is possible to reduce the impact to which the first core 241 is subjected.

The positional relationship between the core holder 208 and second core 242 is set so that when the core holder 208 is moved from the second position to the first position, the second core 242 of the external magnetic core 204 is placed in contact with the coil holder 207 to improve the fixing device 100 in the accuracy with which the second core 242 is positioned. Regarding the amount of force to which the protrusion 242*a* of the second core 242 is subjected by the coil holder 207, the second core 242 is loosely fitted in the core holder 208 so that after it comes into contact with the coil holder 207, it is allowed to move upward (distance α) as shown in FIG. 9. Further, the second core 242 is physically independent from the first core 241. Therefore, it is only the weight of the second core 242 that affects the amount of impact to which the second core 242 is subjected. Therefore, the impact is slight. Further, the second core 242 is prevented by the above described disengagement prevention sheet 288, from disengaging from the core holder 208 when the core holder 208 is moved from the second position to the first position.

That is, although the effect of the positioning of the protrusion 242*a*, which is the bottom side of the second core 242, relative to the excitation coil 202 (fixation belt 101), upon the amount (9.4°/mm, in this embodiment) by which heat is generated by electromagnetic induction, is substantial, the fixing device 100 is structured so that the protrusion 242*a* comes into contact with the coil holder 207 while preventing the second core 242 from being damaged. Therefore, it is possible to prevent the fixation belt 101 from becoming nonuniform in temperature in terms of its lengthwise direction. Further, the first and second cores 241 and 242 are made physically independent from each other. Therefore, the second core 242 can be positioned relative to the excitation coil 202 (fixation belt 101) at a high level of accuracy, regardless of the errors in the shape of the first core 241.

For example, in a case where the magnetic core 203 (which is equivalent to external magnetic core in this embodiment) is a one-piece core, like the one in the referential fixing device 100, the projection 203T catches the entire load which the magnetic core 203 carries while it is moved. In comparison, in this embodiment, the force to which the second core 242 is subjected comes from the weight of the second core 242 alone, being therefore, substantially smaller.

As described above, according to this embodiment, it is possible to reduce the impact to which the external magnetic core 204 is subjected when the external magnetic core 204 positioned in the movable core range E is moved from its farthest position from the excitation coil 202, to its closest position. Therefore, it is possible to reduce the possibility that the external magnetic core 204 will be damaged during the above-described movement of the external magnetic core 204.

6. Core Moving Mechanism

In this embodiment, a method for sliding the core holder 208 is used as the method for moving the core holder 208. However, the structure of the mechanism for sliding the core holder 208 to the first or second position is optional.

Figure 10:
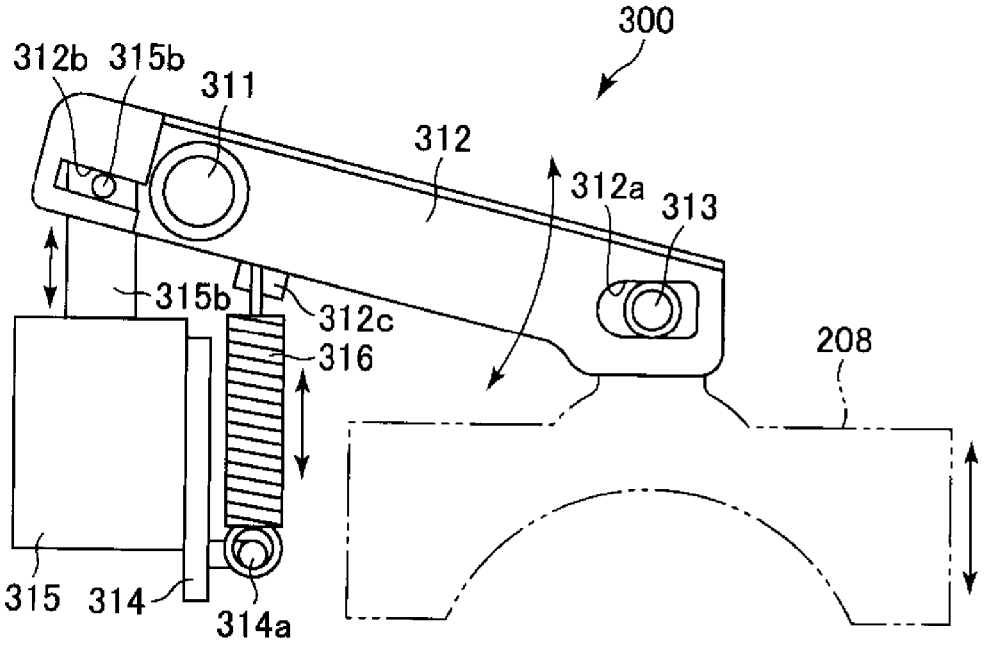
FIG. 10 is a schematic side view of an example of a core moving mechanism.

FIG. 10 is a schematic side view of an example of a core moving mechanism 300. It shows the general structure of the mechanism 300. This core moving mechanism 300 has a pivotally movable lever 312, a solenoid 315 as a driving means for moving the lever 312, and so on. The fixing device 100 may be provided with multiple core moving mechanisms 300 so that each core holder 208 which holds a single or multiple external magnetic cores 204 positioned in the movable core range E is provided with its own core moving mechanism 300.

To describe in detail, the pivotally movable lever 312 is fitted around the shaft 311 (pivot) with which the frame of the fixing device 100 is provided, so that the lever 312 can be pivotally moved about the shaft 311. The pin shaft 313 with which the core holder 208 is provided is fitted in the elongated hole 312*a* with which the opposite end portion of the lever 312 from the shaft 311 is provided. Thus, the lever 312 becomes connected to the core holder 208. Further, the solenoid 315 is solidly attached to the supporting plate 314 with which the frame of the fixing device 100 is provided. Further, the pin shaft 315*b* with which the plunger 315*a* of the solenoid 315 is provided is fitted in the elongated hole 312*b* with which the opposite end portion of the lever 311 from the elongated hole 312*a* is provided; the solenoid 315 and lever 312 are connected to each other. Further, a tension spring 316 is placed between the spring anchor 312*c* with which the arm side of the lever 312 is provided, and the spring anchor 314*a* with which the supporting plate 314 is provided, in such a manner that the spring 316 remains stretched. Thus, the lever 312 remains under the tensile force of the tension spring 316, which works in the direction to cause the lever 312 to pivot about the shaft 311 in the direction to cause the core holder 208 to move toward the bottom portion 271 of the coil holder 207.

When the solenoid 315 is off, the plunger 315*a* is not under the force which works in the direction to pull the plunger 315*a* into the solenoid 315. Therefore, the lever 312 is pivotally moved about the shaft 311 by the tensile force of the tension spring 316, causing thereby the core holder 208 to move toward the bottom portion 271 of the coil holder 207. Consequently, the core holder 208 is moved into the first position. On the other hand, as the electric power for the solenoid 315 is turned on, the plunger 315*a* is pulled into the solenoid 315. Therefore, the lever 312 is pivotally moved about the shaft 311, causing thereby the core holder 208 to move away from the bottom portion 271 of the coil holder 207, while stretching the spring 316 against the tensile force of the spring 316. Consequently, the core holder 208 is moved into the second position.

In this embodiment, a method for sliding the core holder 208 is used as the method for moving the core holder 208. However, the method for moving the core holder 208 does not need to be the method for sliding the core holder 208. That is, it may be a method other than the sliding method, as long as it can ensure that a preset positional relationship is maintained between the excitation coil 202 and the movable external magnetic core 204. A case in which another method is used as the method for moving the movable external magnetic core 204 is described during the description of the second embodiment of the present invention.

Further, in this embodiment, a case in which the external magnetic core 204 is positioned on the inward side of the wound portion 202*a* of the excitation coil 202 in terms of the lengthwise direction of the fixing device 100 is described as an example of positioning of the external magnetic core 204 on the inward side of the wound portion 202*a* of the excitation coil 202 in terms of the lengthwise direction of the external magnetic core 204. However, an external magnetic core 204 may be positioned on the outward side of the wound portion 202*a* of the excitation coil 202, in order to increase the fixation belt 101 in terms of its range across which it generates heat. In the case in which the external magnetic core 204 is placed on the outward side of the wound portion 202*a* of the excitation coil 202, however, the external magnetic core 204 positioned on the outward side of the wound portion 202*a* of the excitation coil 202 also is accurately positioned relative to the coil holder 207 as described above.

7. Electrically Conductive Member

Figure 11:
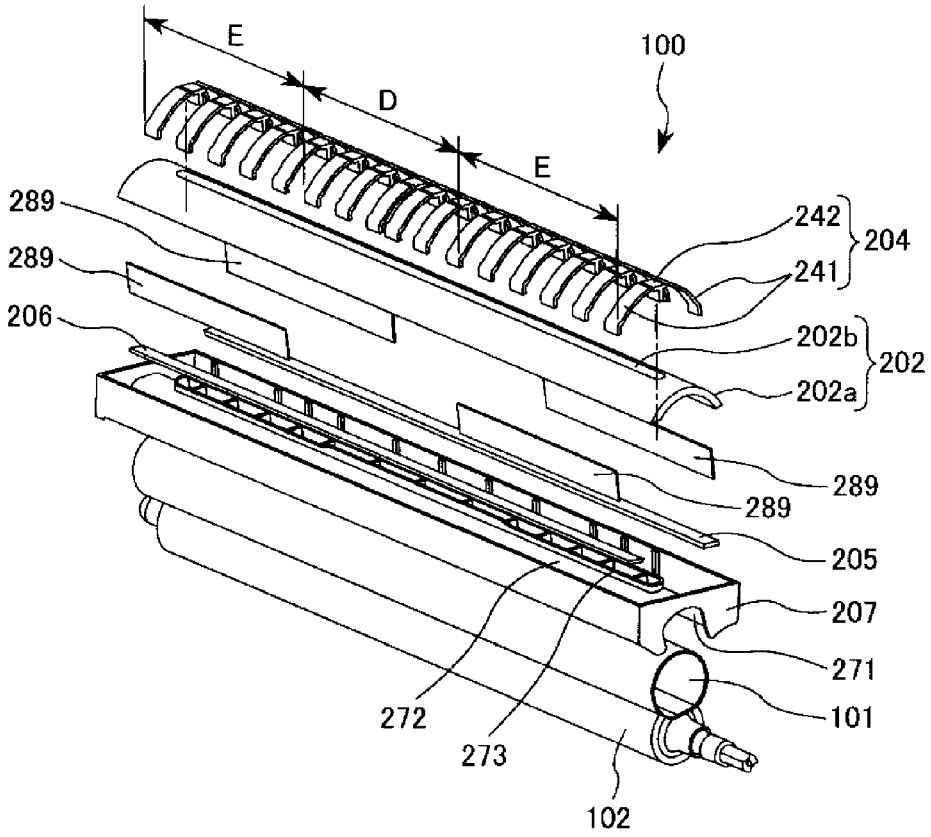
FIG. 11 is an exploded perspective view of a modified version of the fixing device in the first embodiment, minus the portions which are not directly related to the present invention.
Figure 12:
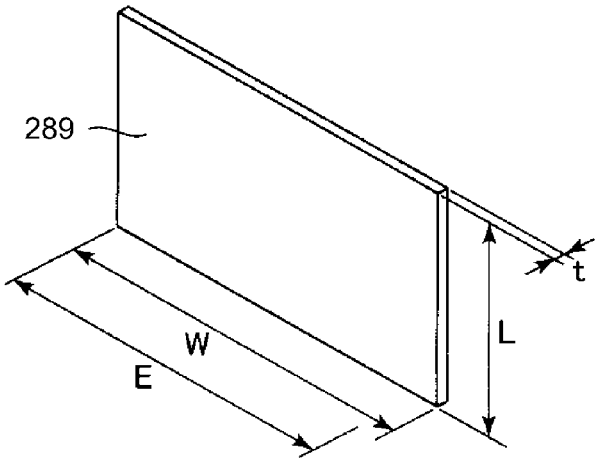
FIG. 12 is a perspective view of the electrically conductive member employed by the modified version of the fixing device in the first embodiment of the present invention.
Figure 13:
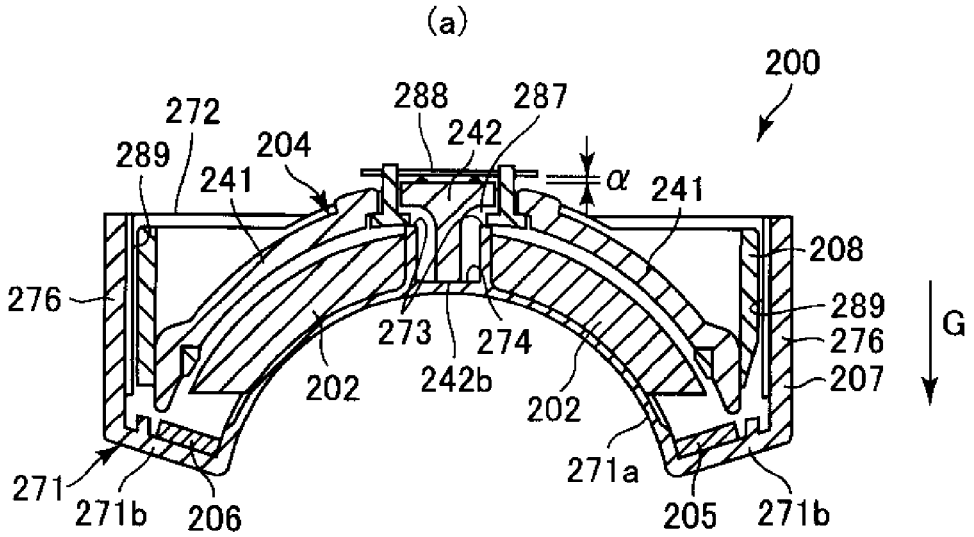
FIG. 13 is a sectional view of the core holder and coil holder of the modified version of the fixing device in the first embodiment, and shows the positional relationship between the core holder and coil holder when the core holder is in the first and second position.
Figure 13:
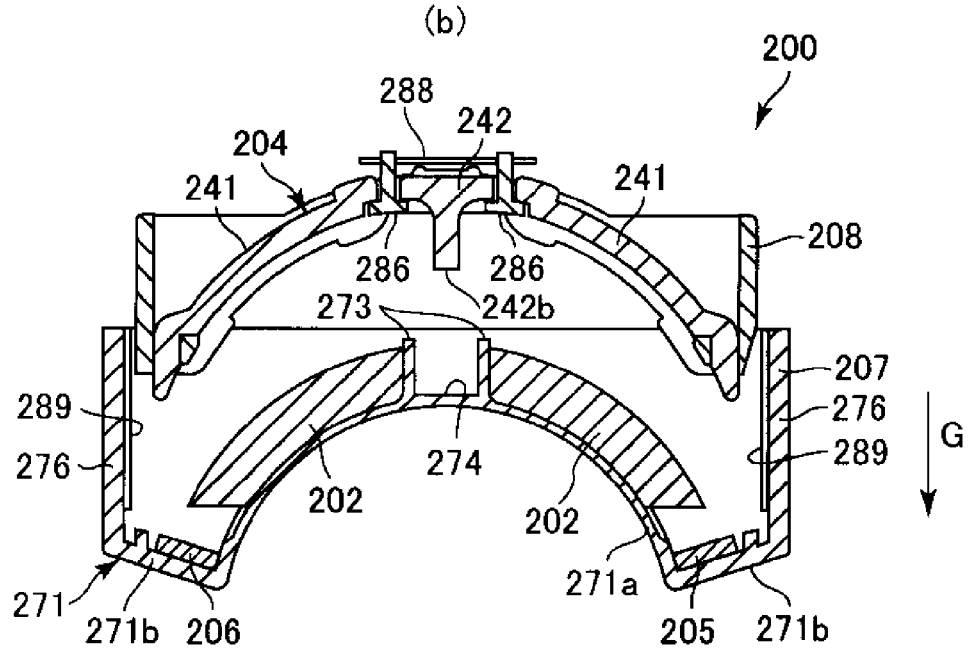
Figure 14:
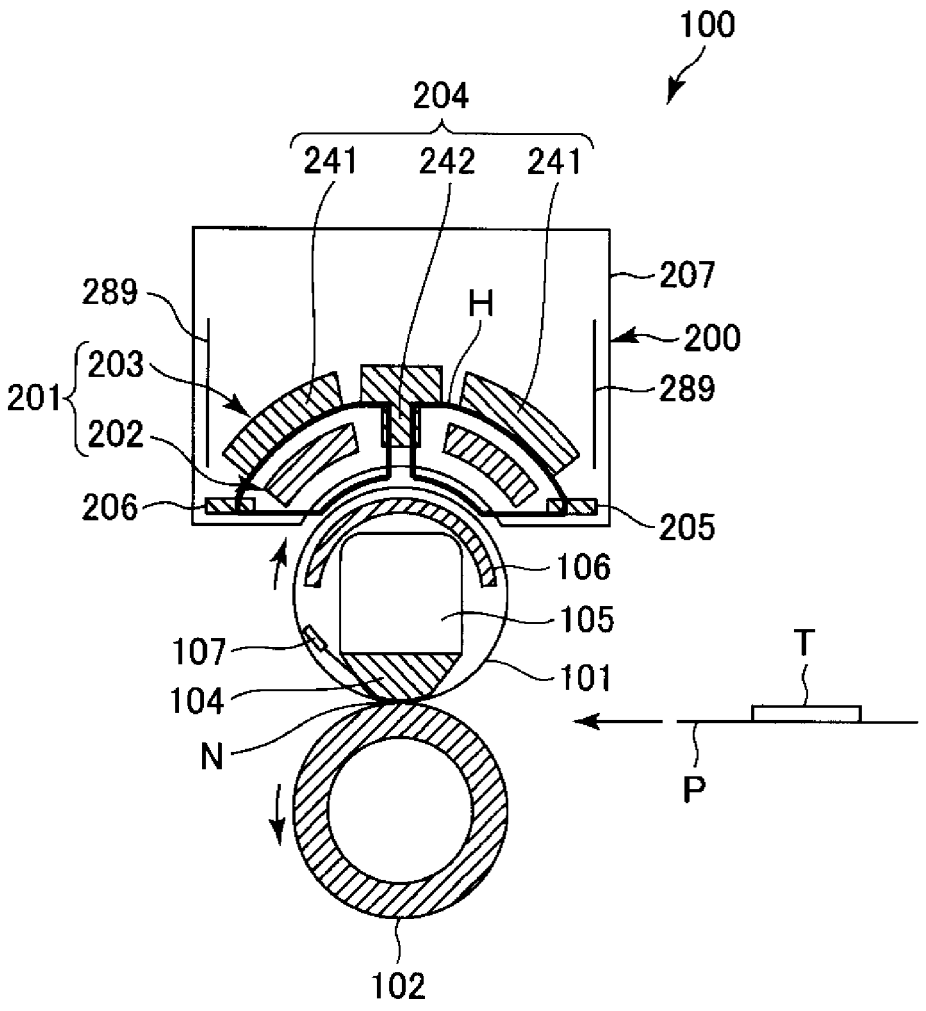
FIG. 14 is a schematic sectional view of the modified version of the fixing device in the first embodiment of the present invention.
Figure 15:
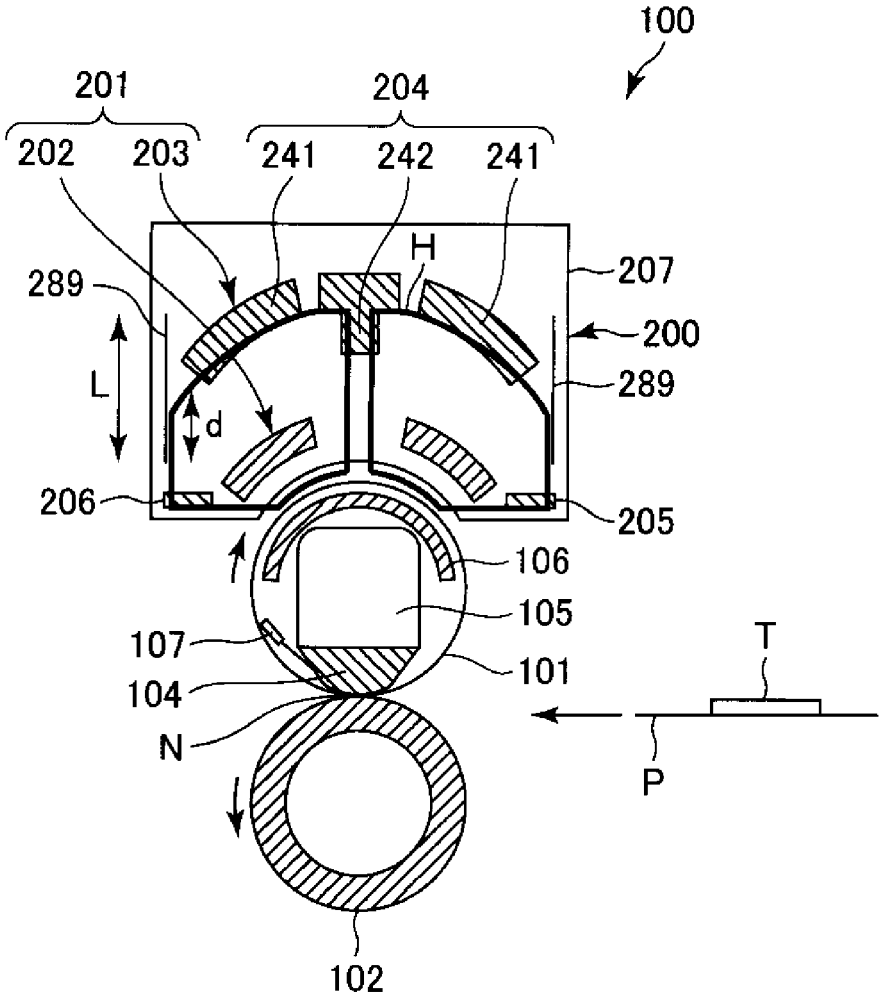
FIG. 15 is a schematic sectional view of the modified version of the fixing device in the first embodiment of the present invention.

Next, the structure of one of the modified version of the fixing device in this embodiment of the present invention, which moves the magnetic cores to reduce the amount of the leakage of magnetic flux is described. FIG. 11 is an exploded perspective view of this modified version of the fixing device in this embodiment, minus its portions which are not directly related to the present invention. FIG. 12 is a schematic sectional view of the electrically conductive member of this modified version, which will be described later. FIGS. 13(*a*) and 13(*b*) are sectional views of the combination of the core holder 208 and coil holder 207 of the fixing device in this modification the first embodiment, when the core holder 208 is in the first and second positions, respectively. FIGS. 14 and 15 are schematic sectional views of the fixing device 100 in this modification of the first embodiment, when the external magnetic cores 204 positioned in the movable core ranges E are in their closest position to the excitation coil 202, and in their farthest position from the excitation coil 202, respectively. The basic structure and operation of the fixing device in this modification of the first embodiment is practically the same as those of the fixing device in this embodiment. Thus, the elements of the fixing device in this modification of the first embodiment, which are the same as, or equivalent to, the counterparts in the fixing device in this embodiment, in function and structure, are given the same referential codes as those given to the counterparts.

In this modification of the first embodiment, the fixing device 100 is provided with a pair of electrically conductive members 289, which are positioned on the outward side of the external magnetic core 204 which is a movable magnetic core and is positioned in the movable core range E, and on the inward side of the lateral long walls 276 and 276 of the coil holder 207. These conductive members 289 are solidly attached to the inward surfaces of the upstream and downstream long lateral walls 276 and 276, at the end portions of the coil holder 207, which correspond in position to the ranges E, one for one, in terms of the lengthwise direction. The conductive members 289 are positioned so that they oppose the space through which the external magnetic core 204 positioned in the movable core range E move to be placed in its farthest position from the excitation coil 202. The conductive members 289 are magnetic flux adjusting members for reducing this space in magnetic flux density. They are made of thin plate of metallic substance which is low in permeability, for example, and are solidly attached to the aforementioned lateral walls of the coil holder 207, with the use adhesive as solidly attaching means.

First, the effect (effect A) of the conductive member 289 attributable to the movement of the magnetic core is described.

Referring to FIG. 14, when a large sheet P of paper is used as recording medium, the external magnetic core 204 positioned in the movable core range E is moved into, and kept in, its closest position to the excitation coil 202. It is when the fixing device 100 is in the state shown in FIG. 14 that the pressure roller 102 is rotationally driven, and the excitation coil 202 is supplied with electric power, to make the fixing device to perform the fixing operation. In this case, therefore, the fixation belt 101, the entirety of the portion of the fixation belt 101, which corresponds in position to the path of the large sheet P of recording medium (range A in FIG. 3) roughly uniformly generates heat. The magnetic circuits formed in the adjacencies of the excitation coil 202 when the external magnetic cores 204 positioned in the left and right ranges E are in their closest position to the excitation coil 202 are indicated by sold bold lines H in FIG. 14. These magnetic circuits are formed by the external magnetic cores 204 positioned in the left and right ranges E, upstream and downstream magnetic cores 205 and 206, and the metallic layer (induction heat generating member) 101*a* of the fixation belt 101.

Referring to FIG. 15, in a case where recording medium is a small sheet P of recording medium, the distance (gap) between the external magnetic cores 204 positioned in the left and right movable core ranges E, and the excitation coil 202, is greater than when a large sheet P recording medium is used. It is when the fixing device 100 is in the state shown in FIG. 15 that the pressure roller 102 is rotationally driven, and the excitation coil 202 is supplied with electric power to make the fixing device 100 to perform a fixing operation. The magnetic circuits formed in the adjacencies of the excitation coil 202 when the external magnetic cores 204 positioned in the left and right ranges E are in their farthest position from the excitation coil 202 are indicated by solid bold lines H in FIG. 15. When the fixing device 100 is in the state shown in FIG. 15, the magnetic circuits formed in the adjacencies of the excitation coil 202 are lower in efficiency. In this case, therefore, the portion of the fixation belt 101, which correspond in position to the areas (areas C in FIG. 3) between the left edge of the path of a small sheet P of recording medium and the left edge of the path of a large sheet P of recording medium, and the portion of the fixation belt 101, which corresponds in position to the right edge of the path of the small sheet P and the right edge of the large sheet P, are less in the amount of heat generation.

Next, the function (function B) of the electrically conductive member 289 is described.

When the fixing device 100 is in the state shown in FIG. 15, the conductive members 289 are in the spaces formed by the movement of the external magnetic cores 204 positioned in the left and right ranges E, and are held by the coil holder 207. The conductive members 289 can reduce the amount by which the electromagnetic flux leaks out of the fixing device 100. In addition, it plays also the following role.

That is, since the electrically conductive member 289 intersects with a part of the magnetic flux H generated by the excitation coil 202, the magnetic flux H (FIG. 15) from the excitation coil 202 is affected by the electromagnetic induction. More specifically, since the electrically conductive member 289 is positioned so that it intersects with the magnetic flux H generated by the excitation coil 202, electromagnetic force is generated in the conductive member 289 by an amount proportional to the rate of change of the magnetic flux H (principle of electromagnetic induction), creating thereby a closed circuit (intersectional circuit) which induces electric current in the conductive member 289. The direction of this force, or the direction of the electric current flowed by this electromagnetic force is such that the magnetic flux generated by this current impedes the change in the intersectional magnetic flux. Therefore, the areas in which the electrically conductive members 289 intersect with the magnetic flux H, that is, the ranges E, reduces in magnetic flux density. Therefore, the portions of the fixation belt 101, which correspond in position to the ranges E reduces in the amount by which they generate heat.

As described above, basically, the unwanted increase in temperature which is likely to occur across the out-of-sheet path portions of the fixation belt 101, when a small sheet P of recording medium is used, can be controlled (prevented) by the above described function A of the electrically conductive member 289. Further, in a case where the fixing device 100 is provided with the electrically conductive members 289, the unwanted increase in temperature which is likely to occur across the out-of-sheet path portions of the fixation belt 101, when a small sheet P of recording medium is used, can be controlled (prevented) at a higher level of effectiveness, because the combined effects of the above described functions A and B.

Further, the fixing device 100 is structured so that the electrically conductive members 289 are stationary, and only the external magnetic cores 204 positioned in the left and right ranges E are movable. Therefore, the fixing device 100 is less complicated in overall structure, and is smaller than the fixing device in this embodiment.

From the standpoint of reducing the fixing device 100 in electric power consumption while preventing the electrically conductive members 289 from being increased in temperature by the heat generated in themselves, it is desired that the conductive members 289 are formed of a conductive substance which is low in permeability. That is, the conductive members 289 is desired to be no less than 0.9, and no more than 1.1, in permeability. As the desirable material for the electrically conductive member 289, copper, aluminum, silver, lead, and the like can be listed, which are 0.999991, 1.00002, 0.99998 and 0.999983, respectively, in permeability. Further, from the standpoint of reducing the amount by which the electrically conductive members 289 generate heat, the electrically conductive members 289 are desired to be made of metallic plate which is low in electrical resistance.

The principle of electric magnetic induction is that as electric current flows through an object with which a magnetic flux intersects, heat is generated in the object by the electric power, amount of which is proportional to the skin resistance Rs of the object. The skin depth δ of the object can be expressed as follows:

$$\delta=(2\rho/\mu\omega)1/2$$

wherein ω, μ and ρ stand for angular frequency, permeability, and specific resistance, respectively.

Further, the skin resistance Rs is expressed as follows:

$$Rs=\rho/\delta$$

The amount of electric power W generated in the object with which the magnetic flux intersects can be expressed as follows:

$$W\propto Rs\int|I|2dS$$

wherein I stands for electric current.

Thus, the smaller the electrically conductive members 289 in permeability, the smaller the conductive members 289 in the amount of electric power W generated therein, and therefore, the smaller the conductive members 289 in the amount by which heat is generated therein. Further, the smaller the conductive members 289 in specific resistance, the smaller the conductive members 289 in the amount of electric power W generated therein, and therefore, the smaller in the amount by which heat is generated therein.

On the other hand, in this modified version of this embodiment, in order to prevent the magnetic flux from leaking through the electrically conductive members 289, the electrically conductive members 289 are structured so that their thickness t (FIG. 12) is greater than its skin depth δ. As described above, the skin depth δ is determined by the permeability μ of the electrically conductive member 289, specific resistance ρ of the electrically conductive member 289, and angular frequency ω of the magnetic flux. In this connection, in a case where the thickness t of the electrically conductive member 289 is less than the skin depth δ of the conductive member 289, the skin resistance Rs of the conductive member 289 is expressible as follows based on the principle of electromagnetic induction:

$$Rs\approx\rho/t(t\text{: thickness})$$

In this case, therefore, the conductive member 289 is greater in the amount of the heat generated therein.

Further, from the standpoint of ensuring that the electrically conductive members 289 sufficiently reduce the magnetic flux, the electrically conductive members 289 should be positioned in the areas in which the magnetic flux has not dispersed. That is, it is desired that the electrically conductive members 289 are positioned in the areas which are near the excitation coil 202, and in which the external magnetic cores 204 in the left and right ranges E, upstream and downstream magnetic cores 205 and 206, induction heat generating member 101*a*, and conductive members 298 form the magnetic circuit, to prevent as much as possible the magnetic flux from leaking out.

In this modification of this embodiment, the electrically conductive members 289 are positioned in the adjacencies of the paths of the external magnetic cores 204 positioned in the left and right ranges E, one for one, and are directly and solidly attached to the coil holder 207. Also in this modification of the first embodiment, the fixing device 100 is structured so that the length L (FIG. 12) of the external magnetic cores 204 positioned in the left and right ranges E, in terms of the direction in which the external magnetic cores 204 are moved, is longer than the distance d (FIG. 15) by which the external magnetic cores 204 positioned in the left and right ranges E are moved. Therefore, even if the distance between the external magnetic cores 204 and excitation coil 202 is widened by the movement of the external magnetic cores 204, the presence of the electrically conductive members 289 minimize the magnetic flux leakage, minimizing thereby the effects of the magnetic flux upon the components which are in the adjacencies of the fixing device 100. Further, for the purpose of maximizing the magnetic flux reducing effect of the electrically conductive members 289, the length W (FIG. 12) of the conductive member 289 in terms of the lengthwise direction of the fixing device 100 is made longer than the dimension of the movable core range E in the same direction. By the way, the electrically conductive members 289 have only to be positioned in the spaces through which the external magnetic cores 204 positioned in the left and right ranges E move. That is, the fixing device 100 may be structured so that the electrically conductive members 289 cover the outward surface of the external magnetic cores 204 positioned in the left and right ranges E, or the entirety of the magnetic core 203.

8. Prevention of Temperature Increase of Out-of-sheet Path Portion of Fixation Belt Next, referring to FIGS. 16 and 17, the effects of this embodiment (and above described modification of this embodiment) in terms of the prevention of the temperature increase of the portions of the fixation belt 101, which are out of the sheet path, are described more concretely.

Figure 16:
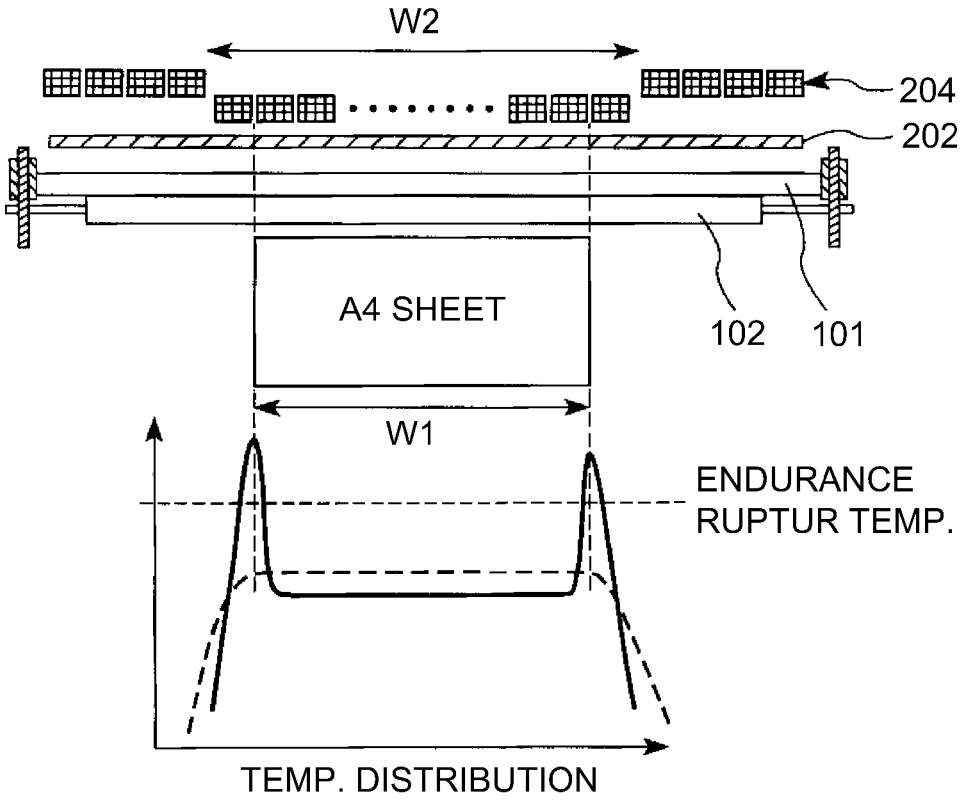
FIG. 16 is a drawing for describing the position of the movable magnetic core, and the temperature distribution of the fixation belt, in terms of the lengthwise direction of the fixing device.
Figure 17:
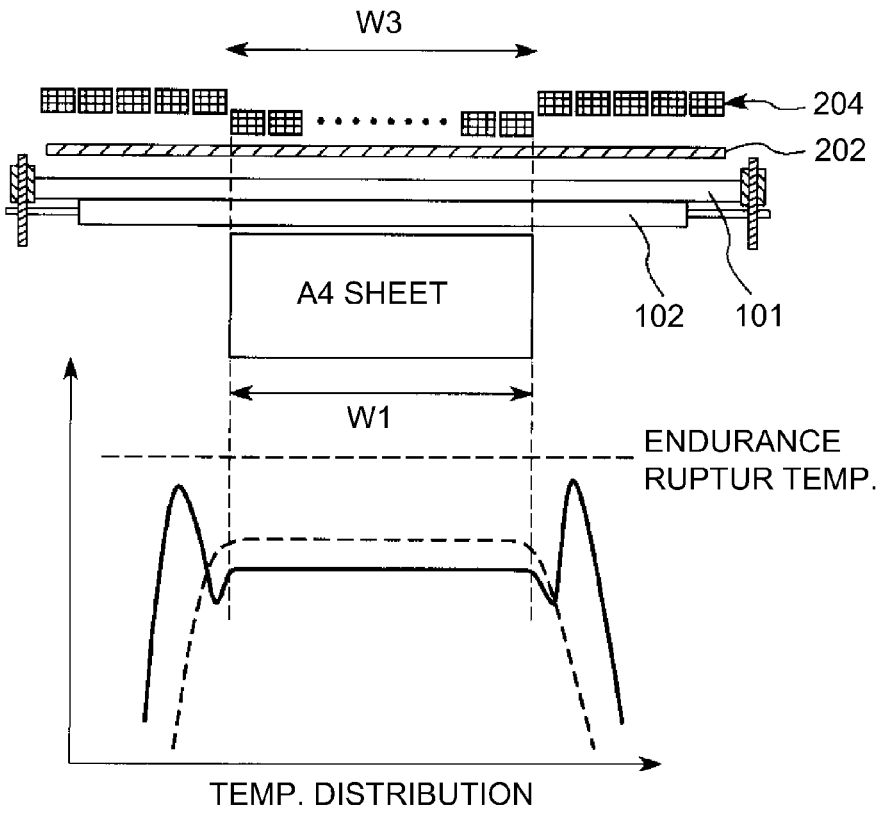
FIG. 17 is a drawing for describing the position of the movable magnetic core, and the temperature distribution of the fixation belt, in terms of the lengthwise direction of the fixing device.

FIGS. 16 and 17 are schematic drawings for describing the effects which the external magnetic cores 204 have when a small sheet P of recording medium, more specifically, a sheet P of recording medium which is W1 in width, is used.

The graph in FIG. 16 shows the temperature distribution of the fixation belt 101 in terms of the lengthwise direction, after the conveyance of the first (dotted line) and 500th (solid line) small sheets P of recording medium, which is W1 in width, when the width W2 of the range across which the magnetic flux is stronger because of the presence of the external magnetic cores 204, is greater than W1. The preset target temperature level (fixation level) of the temperature of the fixing device 100 is 180° C. According to this graph, if the fixing device 100 was set to make the sheet path portion of the fixation belt 101 uniform in temperature distribution, for the first sheet P of recording medium, the temperature of the portions of the fixation belt 101, which are in the adjacencies of the lateral edges of the 500th sheet P, became 270° C. That is, the temperature of these portions of the fixation belt 101 had increased to a level which is substantially higher than the target level. This excessive amount of temperature increase is likely to lead to the endurance rupture of the fixation belt 101. Therefore, it is desired that the fixing device 100 is structured so that these portions of the fixation belt 101 are prevented from excessively increasing in temperature.

In this embodiment (also in above described modification of this embodiment), in order to deal with the excessive temperature increase of the above described portion of the fixation belt 101, the distance between the excitation coil 202 and external magnetic cores 204 is widened across the ranges which are outside the sheet path, so that the fixing device 100 is reduced in the density of the magnetic flux which passes the fixation belt 101, to reduce the amount by which the fixation belt 101 generates heat.

FIG. 17 shows the temperature distribution of the fixation belt 101 in terms of the lengthwise direction, after the conveyance of the first (dotted line) and 500th (solid line) small sheets P of recording medium, which is W1 in width, when the width W3 of the range across which the magnetic flux is stronger because of the presence of the external magnetic cores 204, is the same as W1. According to this graph, the portion of the fixation belt 101, which corresponds in position to the sheet path, was uniform in temperature distribution, being therefore satisfactory in fixation. Further, even after the conveyance of the 500th sheet P of recording medium, the temperature of the portions of the fixation belt 101, which are outside the path of the sheet P which is W1 in width, that is, the out-of-sheet path portions of the fixation belt 101, were kept below the temperature level beyond which the fixation belt is likely to be ruptured (enturance rupture). That is, the graph shows, this embodiment (also modified version of this embodiment) can reduce the possibility of the endurance rupture of the fixation belt 101 due to the excessive temperature increase which occurs to the portions of the fixation belt 101, which are outside the path of the sheet P of recording medium.

As described above, this embodiment (also modified version of this embodiment) widens the distance (gap) between the excitation coil 202 and external magnetic cores 204, across the areas which are outside the path of recording medium, in terms of the lengthwise direction of the fixing device 100, when a small sheet P of recording medium is used as recording medium. Therefore, not only can it keep the fixing device satisfactory in fixation, but also, minimize the possibility that the fixation belt 101 will suffer from endurance rupture.

9. Control

FIG. 18 is a block diagram of the control of the essential portions of the image forming apparatus 1 in this embodiment. It shows the general control of the apparatus 1. The operation of the image forming apparatus 1 is integrally controlled by the control section 50 with which the apparatus 1 is provided. The control section 50 has a CPU 51 as controlling means, a ROM 52 as storing means, a RAM 53 as storing means, and so on. The control section 50 controls the operation of each of the various portions of the image forming apparatus 1, based on the programs and/or data stored in the ROM52 and read out into the RAM 53 as necessary. Regarding the relationship between this embodiment and control section 50, the control section 50 is in connection to the electric power source 103 which applies high frequency current to the inductive heat generating section 200 of the fixing device 100, motor M1 which rotationally drives the pressure roller 102 of the fixing device 100, and so on. Further, the control section 50 is in connection to the temperature sensor 107 which detects the temperature of the fixation belt 101 of the fixing device 100, driving means for driving the core moving mechanism 300 which moves the core holder 208 of the fixing device 100, and so on.

Figure 19:
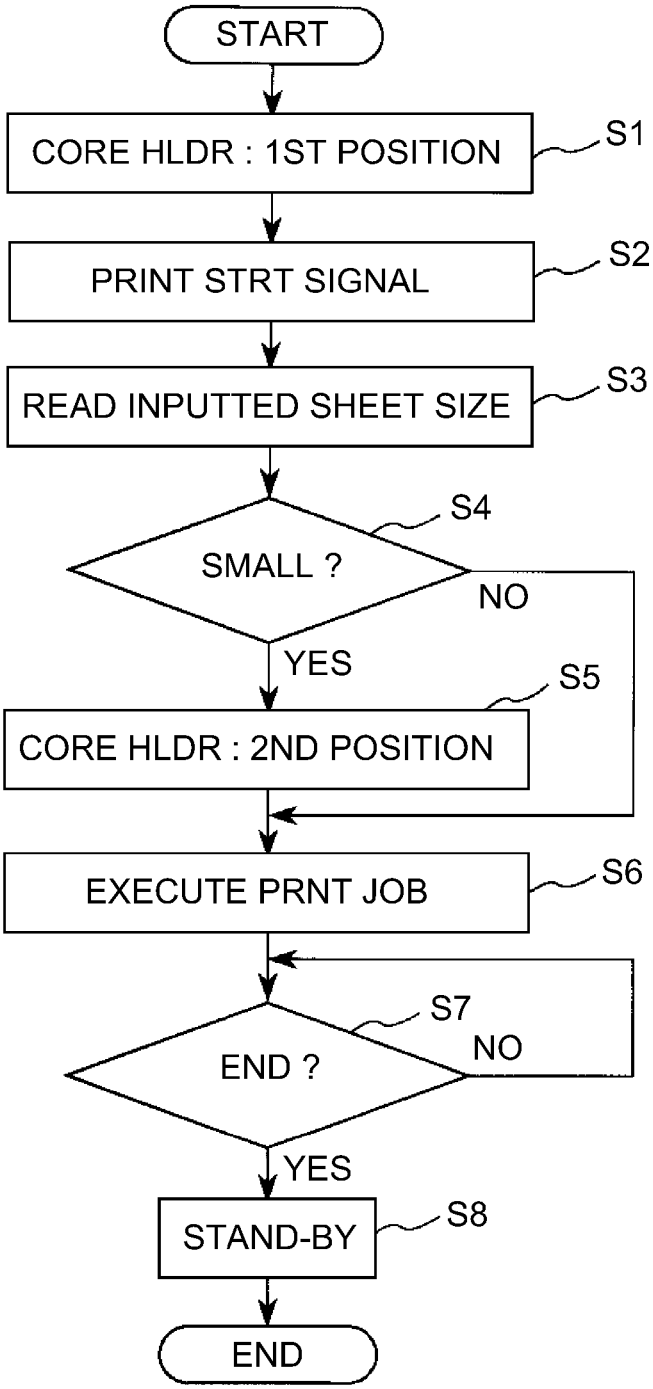
FIG. 19 is a flowchart for roughly describing the image forming operation of the image forming apparatus in this embodiment.

FIG. 19 is a flowchart of the operation to be carried out by the image forming apparatus 1 to form an image. It shows the general control of the operation of the apparatus 1. When the image forming apparatus 1 is kept on standby, the control section 50 keeps the core holders 208 which are holding the external magnetic cores 204 in the ranges E, in the first position by the core moving mechanism 300 (Step 1). Then, as a print start signal is inputted (Step 2), the control section 50 reads the size of the sheet P of recording medium to be used for the image formation, from the information inputted from an external host apparatus, or through the recording medium size inputting means of the control panel (unshown) of the image forming apparatus 1 (Step 3). Then, the control section 50 determines whether the inputted value indicates that it is a small or large sheet of recording medium that is used for the image formation (Step 4). If the control section 50 determines that the recording medium is a small sheet P of recording medium, it moves the core holder 208 which are holding the external magnetic cores 204 positioned in the ranges E, to the second position, with the use of the core moving mechanism 300 (Step 5). Then, it makes the image forming apparatus 1 carry out a printing job set for outputting a preset number of prints (Step 6). As soon as the printing job is completed (Step 7), the control section 50 puts the image forming apparatus 1 on standby, and waits for the print start signal for the next printing job (Step 8). On the other hand, if the control section 50 determines that the recording medium is a large sheet P of recording medium, it keeps the core holder 208 in the first position, and makes the image forming apparatus 1 perform the printing job for outputting a preset number of prints (Step 6). Then, as soon as the printing job is finished (Step 7), the control section 50 puts the image forming apparatus 1 on standby, and waits for the inputting of the print start signal for the next printing job (Step 8).

10. Effects

As described above, in this embodiment, among the multiple external magnetic cores 204 positioned in parallel in the lengthwise direction of the fixing device 100, those positioned in the ranges E are movable. Therefore, it is possible to prevent the portions of the fixation belt 101, which are outside the path of a small sheet P of recording medium, from excessively increasing in temperature. Further, according to this embodiment, it is possible to make the fixing device 100 roughly uniform in the positional relationship between the external magnetic cores 204 positioned in the ranges E, excitation coil 202, and metallic layer (induction heat generating member) 101*a* of the fixation belt 101, in terms of the lengthwise direction of the fixing device 100. Therefore, it is possible to make the fixation belt 101 roughly uniform in temperature in terms of the lengthwise direction.

Further, it is possible to minimize the impact to which the external magnetic cores 204 positioned in the ranges E are subjected when the core holder 208 is moved from the second position to the first position to move the external magnetic cores 204 from their farthest position from the excitation coil 202 to their closest position to the excitation coil 202.

As described above, according to this embodiment, it is possible to achieve both the objective of preventing the portions of the fixation belt 101, which are out of the path of a small sheet P of recording medium, from excessively increasing in temperature, and the objective of keeping the fixation belt uniform in temperature in the lengthwise direction, while minimizing the possibility that the external magnetic cores 204 will be damaged.

[Embodiment 2]

Next, the another embodiment of the present invention is described. The image forming apparatus and its fixing device in this embodiment are the same in basic structure and operation as those in the first embodiment. Thus, elements of the image forming apparatus and fixing device in this embodiment, which are equivalent in function and structure as the counterparts in the first embodiment are given the same referential codes as those given to the counterparts, and are not described in detail here.

This embodiment is different from the first embodiment in the structure of the coil holder 207, core holder 208, and the core moving mechanism 300.

Figure 20:
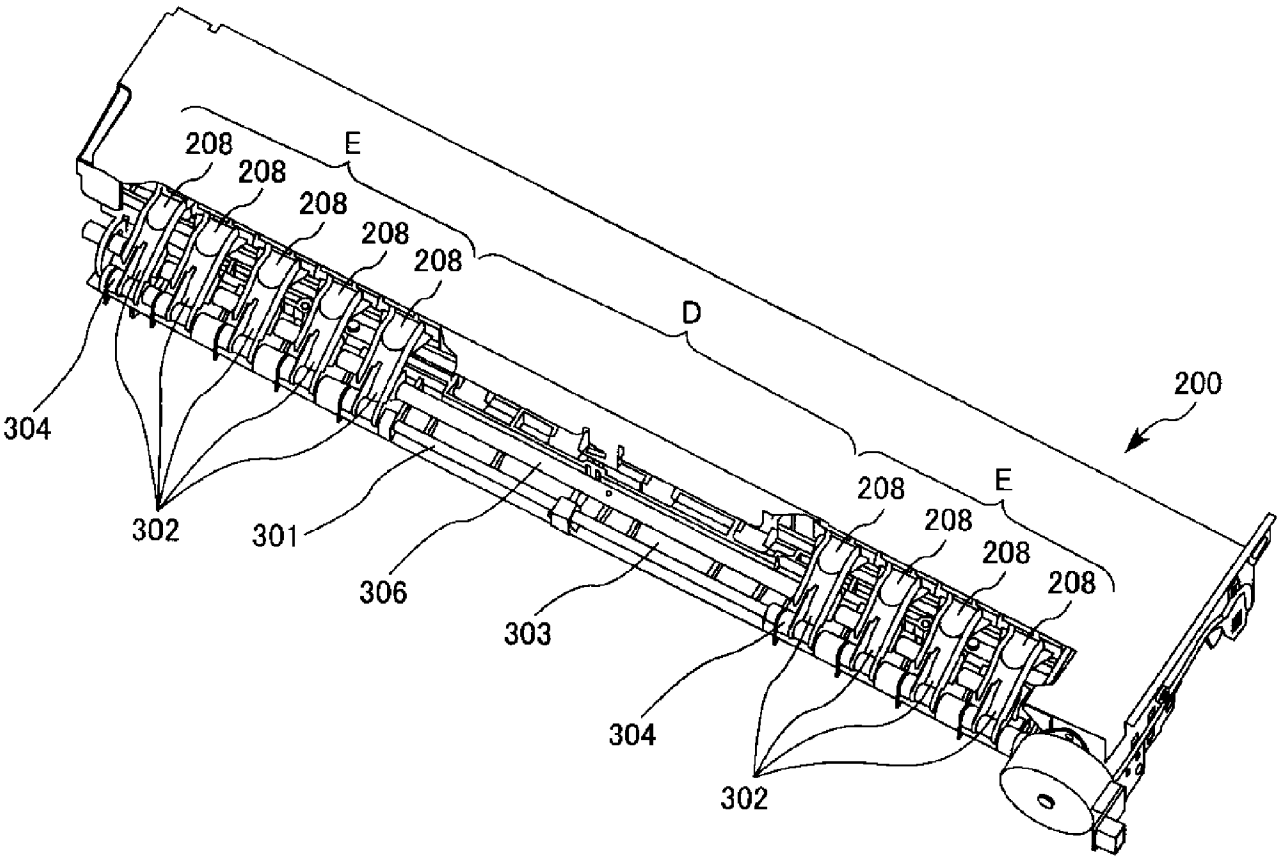
FIG. 20 is a perspective view of the fixing device in another embodiment of the present invention, minus the portions of the fixing device which are not directly related to the present invention.
Figure 21:
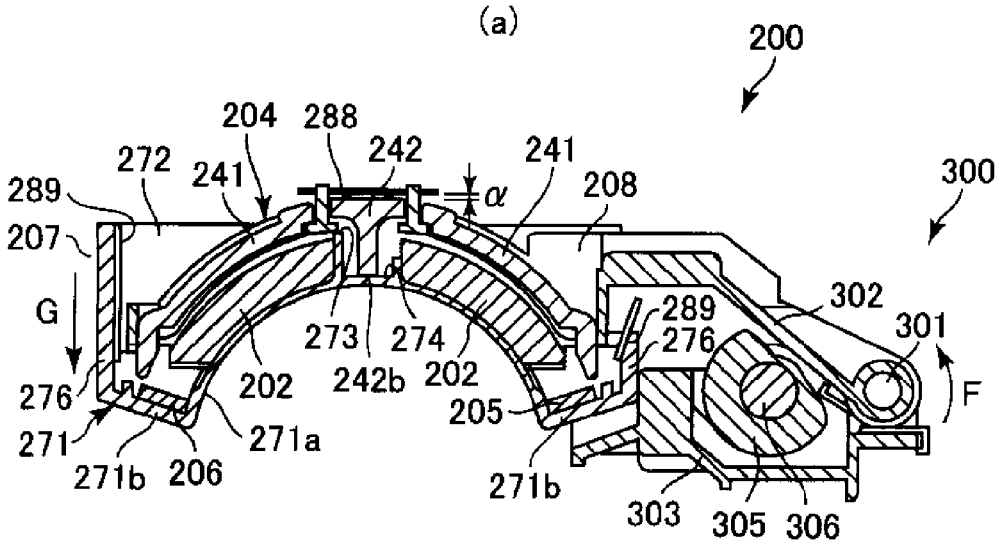
FIG. 21 is a sectional view of the core holder and coil holder in another (second) embodiment of the present invention, and shows positional relation between the core holder and coil holder when the core holder is in the first and second positions.
Figure 21:
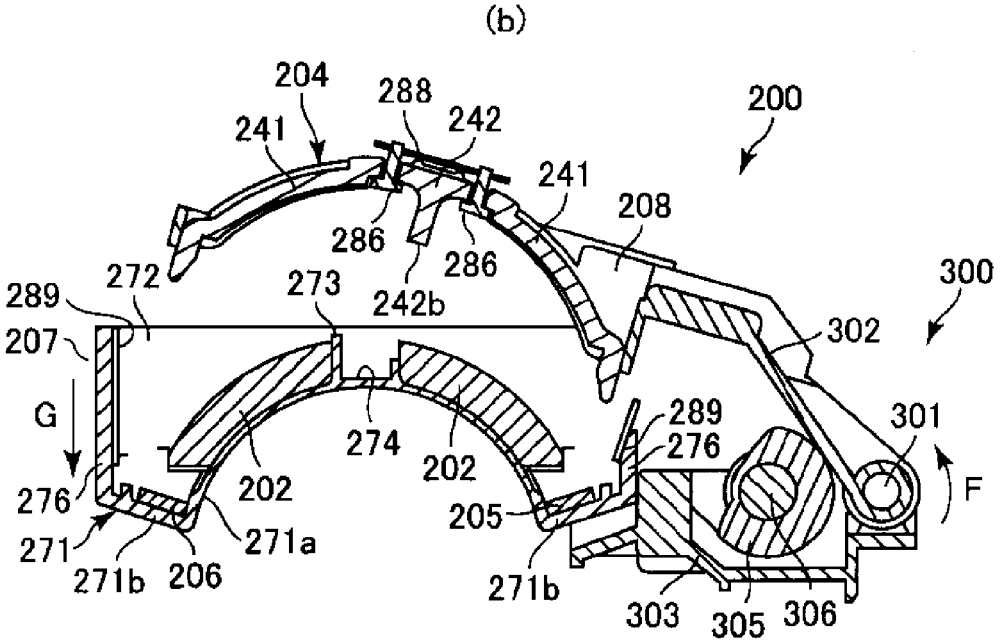

FIG. 20 is an external perspective view of the induction heating section 200 in this embodiment, minus its portions which are not directly related to the present invention. FIGS. 21(*a*) and 21(*b*) are sectional views of the combination of the core holder 208 and coil holder 207 when the core holder 208 is in its first and second positions, respectively.

In the first embodiment, the method for sliding the core holder 208 was used as the method for moving the core holder 208. In this embodiment, a method for rotating (pivotally moving) the core holder 208is used as the method for moving the core holder 208.

In this embodiment, the multiple external magnetic cores 204 positioned in the ranges E are held by the core holder 208 which is movable to the first and second positions by the core holder moving mechanism 300 as a core holder moving means.

Next, referring to FIG. 20, the fixing device 100 is structured so that multiple core holders 208 hold multiple external magnetic cores, one for one. However, it may be structured so that some of the core holders 208 hold two or more external magnetic cores 204 as it was in the first embodiment. Also in this embodiment, the multiple external magnetic cores 204 positioned in the range D, are solidly attached to the coil holder 207, with the placement of a stationary core holder between themselves and the coil holder 207, as in the first embodiment. This stationary core holder is the same as the above described core holder 208 in terms of how they hold the external magnetic cores 204. It however is kept stationary only in its first position.

In terms of how each external magnetic core 204 is held by a core holder, the core holder 208 in this embodiment is roughly the same in structure as that in the first embodiment. Next, referring to FIGS. 21(*a*) and 21(*b*), the short lateral portions 281 and 281, and long lateral portions 282 and 282, in this embodiment are different in shape, and the attributes related to shape, as those in the first embodiment, but, are practically equivalent to those in the first embodiment in functionality.

Further, the coil holder 207 in this embodiment has a protrusion 275 which protrudes from the arch portion 271*a* of the bottom portion 271 in the opposite direction from the fixation belt 101, as the coil holder 207 in the first embodiment does. In this embodiment, however, in practical terms, it is only the tip portion of the protrusion 275, which extends in the lengthwise direction of the fixing device 100 toward the center (hole) 202*b* of the wound portion 202*a* of the excitation coil 202, on the downstream side, that protrudes beyond the outward surface of the wound portion 202*a* of the excitation coil 202. This tip portion is the first area 273 of contact. In this embodiment, therefore, it is the bottom surface of the second core supporting portion 284*a* of only the core supporting downstream bridge beam 284 of the core supporting second bridge beams 284, that functions as the catching portion 286 which comes into contact with the first area 273 of contact.

Further, in this embodiment, the fixing device 100 is provided with a pair of electrically conductive members 289 which are similar to those in the modified version of the first embodiment described above. The pair of electrically conductive members 289 are on the inward surfaces of the portions of the downstream lateral long wall 276, which correspond in position to the ranges E. Also in this embodiment, the fixing device 100 is structured so that the opposite end portion of the upstream lateral long wall 276 of the coil holder 207 extends lower than the corresponding end portion of the upstream lateral long wall 276. This opposite end portion of the upstream lateral long wall 276 from the fixation belt 101 is tilted so that it remains parallel to the tangential line of the theoretical circle, the center of which coincides with the pivot (axial line) of the core moving mechanism which will be described later. It is on this tilted end portion of the upstream lateral wall 276, which corresponds in position to the movable core range E, that the electrically conductive member 289 is positioned.

The core moving mechanism 300 in this embodiment is made up of a pivot (axle) 301, an arm 302, a base 303, a coil spring 304, a cam 305, a cam shaft 306, and so on. The axle 301 is on the upstream side of the coil holder 207 and core holder 208, and extends in the lengthwise direction of the fixing device 100. It is supported by the base 303 attached to the coil holder 207, by its lengthwise ends. The arm 302 is pivotally supported by the axle 301 (pivot). It is connected to the upstream lateral short wall 283 of the core holder 208. Thus, the core holder 208 is supported by the base 303 in such a manner that it can be pivotally moved about the shaft (pivot) 301.

In this embodiment, the arm 302 is an integral part of the core holder 208. However, the arm 302 may be independently formed from the core holder 208 to be solidly attached to the core holder 208 with the use of a proper means for solidly attaching the arm 302 to the core holder 208. Also in this embodiment, the base 303 and coil holder 207 are independently formed from each other, and are solidly attached to each other by thermal welding. However, they may be formed together in a singe piece.

The core holder 208 is kept under a preset amount of pressure generated in the direction indicated by an arrow mark F in FIGS. 21(*a*) and 21(*b*) by the torsional coil spring 304, as a pressure applying means, the axial line of which coincides with the axial line of the shaft (pivot) 301. That is, the core holder 208 is kept under the preset amount of pressure generated by the coil spring 304 in the direction to cause the core holder 208 to pivotally move toward the coil holder 207. More specifically, when the core holder 208 is in the first position shown in FIG. 21(*a*), the core holder 208 is kept pressured toward the coil holder 207 so that the catching portion 286 of the core holder 208 remains in contact with the first area 273 of contact of the coil holder 207. Also when the core holder 208 is in the first position, the tip 272*b* of the protrusion 242*a* of the second core 242 of the external magnetic core 204 remains in contact with the second area 274 of contact of the coil holder 207.

That is, the second core 242 is properly positioned by the contact between the tip 242*b* and coil holder 207. The reason where the fixing device 100 is structured as described above is as follows. The magnetic flux generated by the excitation coil 202 concentrates inward of the wound portion 202*a* of the excitation coil 202. Therefore, the strength of the magnetic flux which acts on the fixation belt 101 is significantly affected by the distance between the second core 242 which is on the inward side of the wound wire of the excitation coil 202, and the fixation belt 101. Thus, if the magnetic flux which acts on the fixation belt 101 becomes nonuniform in strength in terms of the lengthwise direction, it is possible that the fixation belt 101 becomes nonuniform in heating performance in terms of the lengthwise direction. Thus, from the standpoint of preventing the fixation belt 101 from becoming nonuniform in heating performance in terms of the lengthwise direction, it is desired that the fixing device 100 is structured so that the multiple second cores 242 aligned in parallel in the lengthwise direction do not become nonuniform in their distance from the fixation belt 101. In this embodiment, therefore, in order to prevent the second cores 242 aligned in parallel in the lengthwise direction from becoming nonuniform in their distance from the fixation belt 101, the fixing device 100 is structured so that each second core 242 is positioned relative to the coil holder 207 by the contact between the tip of the second core 242 and coil holder 207.

Like in the first embodiment, the second core 242 is held in such a manner that it is movable relative to the core holder 208 in the direction indicated by an arrow mark G, and the opposite direction from the direction G, when the core holder 208 is in the first position. Therefore, it does not occur that the second core 242 is pressed upon the coil holder 207 by the force generated by the torsional coil spring 304.

The core holder 208 is moved with the use of the cam 305 and cam shaft 306. The cam shaft 306 is positioned on the upstream side of the coil holder 207 and core holder 208, and on the downstream side of the shaft (pivot) 301, and extends in the lengthwise direction of the fixing device 100. The cam 305 is between the arm 302 and base 303, and is solidly attached to the cam shaft 306. In this embodiment, all the core holders 208 which hold the external magnetic cores 204 positioned in the ranges E are synchronously moved to the first or second position. Thus, all the cams 305 are practically the same in profile in terms of their rotational directions.

Referring to FIG. 21(*a*), when it is necessary to place the core holder 208 in the first position, the cam shaft 306 is to be rotated by a cam shaft driving motor (unshown) as a driving means to move the cam 305 away from the arm 302 so that the external magnetic cores 204 positioned in the ranges E are moved into their closest position to the excitation coil 202.

On the other hand, when it is necessary to place the core holder 208 in the second position, the cam shaft 306 is to be rotated by the abovementioned motor (unshown) as a driving means to cause the cam 305 to push up the arm 302 so that the arm 302 is moved against the resiliency of the torsional coil spring 304. Thus, the external magnetic cores 204 positioned in the ranges E are moved into their farthest positions from the excitation coil 202.

As described above, according to this embodiment, not only can the same effects as those obtainable by the first embodiment be obtained, but also, it is possible to simplify the core moving mechanism 300 in structure.

[Embodiment 3]

Next, another embodiment of the present invention is described. The image forming apparatus and its fixing device in this embodiment are the same in basic structure and operation as those in the first embodiment. Thus, elements of the image forming apparatus and fixing device in this embodiment, which are the same as, or equivalent to the counterparts in the first embodiment in function and structure, are given the same referential codes as those given to the counterparts, and are not described in detail here.

This embodiment is different from the first embodiment in the position of the external magnetic cores 204 in terms of the lengthwise direction of the fixing device 100.

In this embodiment, the multiple external magnetic cores 204 positioned in the ranges E are held by the core holder 208 which are movable to the first or second position by the core moving mechanism 300 as core moving means, as in the first embodiment.

Also in this embodiment, the multiple external magnetic cores 204 positioned in the ranges E are held so that they are movable relative to the coil holder 207, with the placement of the core holder 208 between the external magnetic cores and coil holder 207. Further, the multiple external magnetic cores 204 positioned in the range D, are kept stationary relative to the coil holder 207, with the presence of the stationary core holder between the external magnetic cores 204 and coil holder 207. In terms of the method for holding the external magnetic cores 204, this stationary core holder is the same in structure as the above described core holder 208. However, this stationary core holder is permanently kept in the first position.

Figure 22:
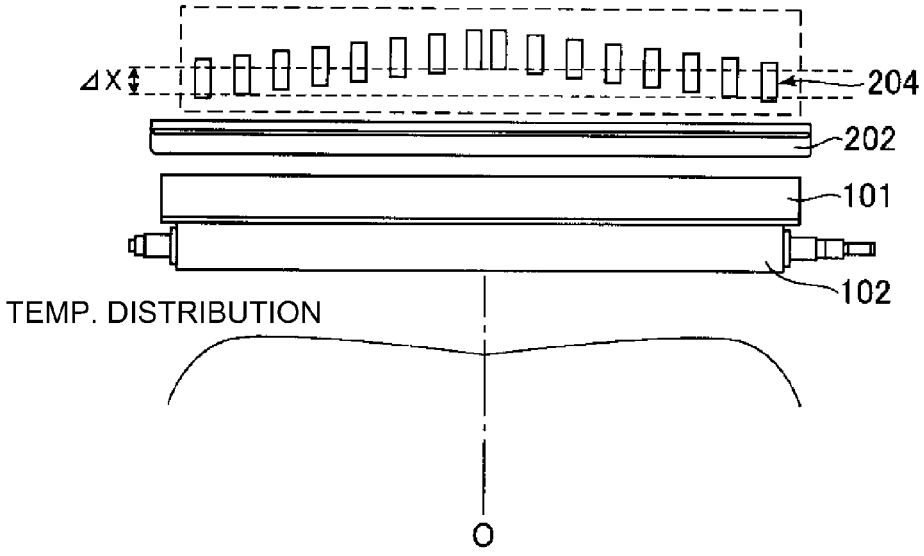
FIG. 22 is a drawing for describing the relationship between the positioning of the magnetic core, and the temperature distribution of the fixation belt, in another (third) embodiment of the present invention.

FIG. 22 is a schematic drawing for showing the relationship between the position of the external magnetic cores 204 and the temperature distribution of the fixation belt 101 in terms of the lengthwise direction.

In the first embodiment, the gap between the multiple external magnetic cores 204 aligned in parallel in the lengthwise direction of the fixing device 100, and the metallic layer (induction heat generating member) 101*a* of the fixation belt 101, was made roughly uniform in terms of the lengthwise direction of the fixing device 100. Therefore, it was possible to make the fixation belt 101 uniform in temperature in terms of the lengthwise direction (FIG. 25(*a*)).

In comparison, in this embodiment, regarding the temperature distribution of the fixation belt 101 in terms of the lengthwise direction, the fixing device 100 is designed so that the end portions of the fixation belt 101 in terms of the lengthwise direction become higher in temperature than the center portion (referential center line O), as shown in FIG. 22, in order to make the end portions of the fixation belt 101, in terms of the lengthwise direction of the fixing device 100, greater in the recording medium conveyance speed than the center portion of the fixation belt 101 to deal with the problem that while a sheet of paper or the like recording medium is conveyed, the sheet is made to wrinkle by the difference between the center portion and the end portions of the sheet P, in the conveyance speed.

In this embodiment, therefore, the distance between the second area 274 of contact of the coil holder 207, and the metallic layer (induction heat generating member) 101*a* of the fixation belt 101, is made larger across the center portion of the fixing device 100 than across the end portions of the fixing device 100 in terms of the lengthwise direction of the fixing device 100. That is, in terms of the lengthwise direction of the fixing device 100, the second area 274 of contact of the coil holder 207, which is the bottom portion 271 of the coil holder 207, is given such a curvature that the height of the roughly center portion (referential center line O) of the bottom portion 271 relative to the lengthwise end of the bottom portion 271 is Δx. Further, in this embodiment, the distance between the first area 273 of contact of the coil holder 207 and the metallic layer (induction heat generating member) 101*a* of the fixation belt 101 is made greater across roughly the center portion of the fixing device 100 than the end portions of the fixing device 100, in terms of the lengthwise direction of the fixing device 100. That is, in terms of the lengthwise direction of the fixing device 100, the first area 273 of contact of the coil holder 207, which is the tip of the protrusion 275 of the coil holder 207, is also given such a curvature that the height of the roughly center portion (referential center line O)

of the tip of the protrusion 275 relative to the lengthwise end of the bottom portion 271 is Δx.

In this embodiment, the positional relationship between the multiple external magnetic cores 204 aligned in parallel in the lengthwise direction of the fixing device 100, and the fixation belt 101, is maintained by the direct contact between the external magnetic cores 204 and coil holder 207, or the indirect contact between external magnetic core 204 and coil holder 207 through the core holder 208, as in the first embodiment. Therefore, the position of each external magnetic core 204 relative to the metallic layer (induction heat generating member) 101*a* of the fixation belt 101 is determined by the curvature of the bottom portion 271 of the coil holder 207. Therefore, the fixation belt 101 can be heated so that its temperature distribution in terms of the lengthwise direction becomes as shown in FIG. 22.

As described above, according to the present invention, even in a case where the external magnetic cores 204 aligned in parallel in the lengthwise direction of the fixing device 100 are not roughly uniformly changed in their distance relative to the metallic layer (induction heat generating member) 101*a* of the fixation belt 101, each external magnetic core 204 can be properly positioned.

[Miscellanies]

The foregoing are the description of the present invention with the reference to the concrete embodiments of the present invention. However, these embodiments are not intended to limit the present invention in scope.

The image forming apparatus and fixing device may be structured so that the position of a sheet of recording medium relative to the image forming apparatus (fixing device) in terms of the direction perpendicular to the recoding medium conveyance direction is set by the placement of one of the lateral edges of the sheet P in contact with the corresponding edge of the recording medium conveyance passage. Thus, all that is necessary when a small sheet of recording medium is used as recording medium is to move the movable magnetic cores which are on the opposite side of the recording medium passage from the positional referential edge of the recording medium passage, in the direction which is roughly perpendicular to the recording medium conveyance direction.

Further, not only may the heating device (apparatus) be a fixing device (apparatus) for fixing the unfixed image on recording medium, but also, a temporarily fixing device for temporarily fixing the unfixed image on recording medium to the recording medium, a surface property altering device (apparatus) (for example, gloss increasing device for increasing image in gloss) for altering in surface properties the image on recording medium by heating the recording medium. Further, the heating device (apparatus) may be a thermal drying device for quickly drying the ink, that is, liquid which contains dye and/or pigment, deposited on recording medium by an image forming apparatus of the inkjet type to form an image on the recording medium. Further, the heating device (apparatus) may be a thermal pressing device for removing wrinkles from paper money, a thermal laminating device, a thermal drying device for evaporating water from a sheet of paper, a heating device for thermally processing a sheet of paper.

Further, the number by which the multiple movable cores are moved may be changed according to the width of a sheet of recording medium. In such a case, the core moving mechanism is desired to be such that it can move each movable magnetic core independently from the other.

Further, in the above described embodiments, the fixing device was divided into the areas (sections) in which multiple magnetic cores aligned in parallel in the lengthwise direction of the fixing device are movable, and the area (section) in which the magnetic cores are not movable. However, the fixing device may be structured so that all the multiple magnetic cores aligned in parallel in the lengthwise direction of the fixing device are movable to their closest position to the excitation coil, and their farthest position from the excitation coil, to enable the fixing device to select the magnetic cores to be moved, according to the width of the sheet of recording medium used for image formation.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 168932/2012 filed Jul. 30, 2012, which is hereby incorporated by reference.

What is claimed is:

1. An image heating apparatus comprising:

a rotatable heating member configured to heat an image on a recording sheet;

an excitation coil provided outside said rotatable heating member and configured to generate heat by electromagnetic induction in said rotatable heating member;

a coil holder configured and positioned to hold said excitation coil;

a plurality of magnetic cores provided outside said rotatable heating member and arranged along a longitudinal direction of the rotatable heating member, wherein at least one of the magnetic cores is a movable magnetic core;

a core holder configured and positioned to hold the movable magnetic core that is movable, said core holder being movable between a first position and a second position which is farther away from said rotatable heating member than the first position; and an urging portion configured to urge said core holder in a direction from the second position toward the first position, wherein said core holder is provided with a stopper portion configured and positioned to stop movement of said core holder from the second position to the first position by abutment to said coil holder, and wherein said core holder permits movement of said movable magnetic core relative to said core holder when said movable magnetic core abuts said coil holder in movement of said core holder from the second position to the first position.

2. An apparatus according to claim 1, wherein said movable magnetic core has a central portion positioned at a winding center of said excitation coil when said core holder is in the first position, and wherein when said core holder is in the first position, said core holder is in contact with said coil holder by said stopper portion, and said central portion is in contact with said coil holder.

3. An apparatus according to claim 2, wherein said core holder is provided with a restricting portion configured to restrict the movement of said movable magnetic core relative to said core holder within a predetermined range to prevent disengagement of said movable magnetic core from said core holder.

4. An apparatus according to claim 3, wherein said restricting portion includes a heat resistive fiber sheet.

5. An image heating apparatus comprising:

a rotatable heating member configured to heat an image on a recording sheet;

an excitation coil provided outside said rotatable heating member and configured to generate heat by electromagnetic induction in said rotatable heating member;

a coil holder configured and positioned to hold said excitation coil;

a plurality of magnetic cores groups arranged along a longitudinal direction of the rotatable heating member and at least one of the magnetic cores groups is a movable magnetic cores group;

a core holder configured and positioned to hold the movable magnetic cores group, said core holder being movable between a first position and a second position which is farther away from said rotatable heating member than the first position; and an urging portion configured to urge said core holder in a direction from the second position towards the first position, wherein said movable magnetic cores group includes a center core provided at a central portion of a winding of the excitation coil and first and second end cores which are disposed opposed to each other with said center core interposed therebetween along an outer peripheral surface of said excitation coil when said core holder is in the first position, wherein said core holder is provided with a stopper portion configured and positioned to stop movement of said core holder from the second position to the first position by abutment to said coil holder, wherein said core holder permits movement of said center core relative to said core holder when said center core abuts said coil holder in movement of said core holder from the second position to the first position.

6. An apparatus according to claim 5, wherein when said core holder is in the first position, said core holder is in contact with said coil holder by said stopper portion, and said center core is in contact with said coil holder.

7. An apparatus according to claim 6, wherein said core holder is provided with a restricting portion configured to restrict the movement of said center core relative to said core holder within a predetermined range to prevent disengagement of said center core from said core holder.

8. An apparatus according to claim 7, wherein said restricting portion includes a heat resistive fiber sheet.

9. An apparatus according to claim 5, wherein said center core of the movable magnetic cores group has a T-shaped section.

10. An apparatus according to claim 5, further comprising a rotatable member configured to feed the recording sheet together with said rotatable heating member, said rotatable heating member including an endless belt rotated by said rotatable heating member.

11. An image heating apparatus comprising:

a rotatable heating member configured to heat an image on a recording sheet;

an excitation coil provided along an outer peripheral surface of said rotatable heating member and configured to generate heat by electromagnetic induction in said rotatable heating member; and a plurality of magnetic core groups arranged along a longitudinal direction of the rotatable heating member, at least one of the magnetic core groups is movable wherein each of said magnetic core groups includes a center core provided at a central portion of a winding of the excitation coil and first and second end cores which are disposed opposed to each other with said center core interposed therebetween along an outer peripheral surface of said excitation coil, and wherein a core holder, configured and positioned to hold the at least one of the movable magnetic core groups and movable between a first position and a second position farther away from the rotatable heating member than the first position, permits movement of said center core of the movable magnetic core group relative to the core holder when said center core of the movable magnetic core group contacts said coil holder in movement of said core holder from the second position to the first position, a stopper portion of the core holder is capable of abutting said coil holder without a relative movement of said first and second end cores of the movable magnetic core group relative to the core holder.

12. An apparatus according to claim 11, further comprising said core holder, wherein said core holder is configured and positioned to hold said plurality of magnetic core groups, said core holder including:

a plurality of through-openings through which said center cores are inserted, said center cores being engaged with edges of respective through-openings with predetermined gaps; and a plurality of retaining portions configured and positioned to prevent disengagement of said center cores from said core holder.

13. An apparatus according to claim 12, wherein said plurality of retaining portions also prevents said first and second end cores from disengaging from said core holder.

14. An apparatus according to claim 12, wherein said plurality of retaining portions each includes heat resistive fiber sheet.

15. An apparatus according to claim 11, further comprising a rotatable member configured to feed the recording sheet together with said rotatable heating member.

16. An image heating apparatus comprising:

a rotatable heating member configured to heat an image on a recording sheet;

an excitation coil provided along an outer peripheral surface of said rotatable heating member and configured to generate heat by electromagnetic induction in said rotatable heating member; and a plurality of magnetic core groups arranged along a longitudinal direction of the rotatable heating member, at least one of which is movable, wherein each group includes a T-shaped core disposed at a central portion of a winding of the excitation coil and first and second arcuate cores which are disposed opposed to each other with said center core therebetween along an outer peripheral surface of the excitation coil, wherein a core holder, configured and positioned to hold the at least one of the movable magnetic core groups and movable between a first position and a second position farther away from the rotatable heating member than the first position, permits movement of said T-shaped core of the movable magnetic core group relative to the core holder when said T-shaped core of the movable magnetic core group contacts said coil holder in movement of said core holder from the second position to the first position, a stopper portion of the core holder is capable of abutting said coil holder without a relative movement of said first and second arcuate cores of the movable magnetic core group relative to the core holder.

17. An apparatus according to claim 16, further comprising said core holder, wherein said core holder is configured and positioned to hold said plurality of magnetic core groups, said core holder including a plurality of through-openings through which said T-shaped cores are inserted, said T-shaped cores being engaged with edges of respective through-openings with predetermined gaps, and a plurality of retaining portions configured and positioned to prevent disengagement of said T-shaped cores from said core holder.

18. An apparatus according to claim 17, wherein said retaining portion also prevents said first and second arcuate cores from disengaging from said core holder.

19. An apparatus according to claim 17, wherein said retaining portions each includes heat resistive fiber sheet.

20. An apparatus according to claim 16, further comprising a rotatable member configured to feed the recording sheet together with said rotatable heating member.

21. An image heating apparatus comprising:

a rotatable heating member configured to heat an image on a recording sheet;

an excitation coil provided outside said rotatable heating member and configured to generate heat by electromagnetic induction in said rotatable heating member;

a coil holder configured and positioned to hold said excitation coil;

a plurality of magnetic cores provided outside said rotatable heating member and arranged along a longitudinal direction of the rotatable heating member, at least one of the magnetic cores is a movable magnetic core;

a core holder configured and positioned to hold the at least one movable magnetic core, said core holder being movable between a first position at which said core holder is contact with said coil holder and a second position which is away form said coil holder;

a stopper portion provided on said coil holder configured to stop movement of said core holder from the second position to the first position by contacting with said core holder; and a contacting portion provided on said coil holder and configured to contact with said movable magnetic core when said core holder is in the first position, wherein said core holder holds said movable magnetic core with some play in a direction toward and away from said coil holder, when said core holder is in the first position.

22. An apparatus according to claim 21, wherein said movable magnetic core has a central portion positioned at winding center of said coil when said core holder is in the first position, and wherein when said core holder is in the first position, said coil holder is in contact with said core holder by said stopper portion, and said coil holder is in contact with said central portion of said movable magnetic core by said contacting portion.

23. An apparatus according to claim 22, wherein said core holder is provided with a restricting portion configured to restrict the movement of said movable magnetic core relative to said core holder within a predetermined range to prevent disengagement of said movable magnetic core from said core holder.

24. An apparatus according to claim 23, wherein said restricting portion includes a heat resistive fiber sheet.

25. An apparatus according to claim 21, further comprising an urging portion configured to urge said core holder in a direction from the second position toward the first position.

* * * * *